US007466836B2

(12) United States Patent
Tilson et al.

(10) Patent No.: US 7,466,836 B2
(45) Date of Patent: Dec. 16, 2008

(54) REMOVAL TOOL FOR IN SITU CERUMEN REMOVAL FROM HEARING DEVICES

(75) Inventors: Alex Tilson, Burlingame, CA (US); Steve Blumenkranz, Redwood City, CA (US); Pat Contioso, Alviso, CA (US); David P. Knight, Mountain View, CA (US); Mitchell Barham, San Mateo, CA (US)

(73) Assignee: InSound Medical, Inc., Newark, CA (US)

( * ) Notice: Subject to any disclaimer, the term of this patent is extended or adjusted under 35 U.S.C. 154(b) by 331 days.

(21) Appl. No.: 11/411,437

(22) Filed: Apr. 25, 2006

(65) Prior Publication Data

US 2007/0003086 A1 Jan. 4, 2007

Related U.S. Application Data

(63) Continuation-in-part of application No. 11/058,097, filed on Feb. 14, 2005.

(51) Int. Cl.
*H04R 25/00* (2006.01)

(52) U.S. Cl. ..... 381/329; 381/322; 381/328; 181/135

(58) Field of Classification Search ..... 381/312, 381/322, 326, 328, 329; 181/129, 130, 135; 600/25; 606/162; 607/56, 57
See application file for complete search history.

(56) References Cited

U.S. PATENT DOCUMENTS 4,817,609 A 4/1989 Perkins et al.
5,401,920 A 3/1995 Oliveira

OTHER PUBLICATIONS

Ballachanda, The Human Ear Canal, Singular Publishing, 1995, pp. 195.

International Search Report and Written Opinion of PCT Application No. PCT/US07/67339, dated Jun. 3, 2008, 11 pages total.

*Primary Examiner*—Brian Ensey
(74) *Attorney, Agent, or Firm*—Townsend and Townsend and Crew LLP

(57) ABSTRACT

A removal tool for atraumatically removing a removable fitting from a hearing device inserted deeply in the ear canal comprises a housing adapted to be grasped in the hand and a plurality of flexible members partially positioned in the housing and extending from the housing. The members have an outwardly flared portion at a distal portion of the member. At least one member includes an engagement element positioned at the flared distal portion of the member for engaging a removal element on the fitting. The tool also comprises a mechanism for engaging the engagement element with the removal element for removal of the fitting independent of a radial orientation of the housing with respect to the hearing device.

21 Claims, 33 Drawing Sheets

REMOVAL TOOL FOR IN SITU CERUMEN REMOVAL FROM HEARING DEVICES

This application is a Continuation-In-Part of U.S. patent application Ser. No. 11/058,097, filed on Feb. 14, 2004, the full disclosure of which is incorporated herein by reference. This Application is also related to concurrently filed U.S. patent application Ser. No. 11/327,283, the full disclosure of which is incorporated herein by reference.

FIELD OF THE INVENTION

Embodiments of invention relate to hearing aids. More specifically, embodiments of the invention relate to systems and methods for improving the resistance of hearing aids to exposure from cerumen and other biological contaminants. Still more specifically, embodiments of the invention relate to systems and methods for the in situ removal of cerumen and other contaminants from hearing aids positioned in the ear canal.

Since many hearing aid devices are adapted to be fit into the ear canal, a brief description of the anatomy of the ear canal will now be presented for purposes of illustration. While the shape and structure, or morphology, of the ear canal can vary from person to person, certain characteristics are common to all individuals. Referring now to FIGS. 1-2, the external acoustic meatus (ear canal) is generally narrow and contoured as shown in the coronal view in FIG. 1. The ear canal 10 is approximately 25 mm in length from the canal aperture 17 to the center of the tympanic membrane 18 (eardrum). The lateral part (away from the tympanic membrane) of the ear canal, a cartilaginous region 11, is relatively soft due to the underlying cartilaginous tissue. The cartilaginous region 11 of the ear canal 10 deforms and moves in response to the mandibular (jaw) motions, which occur during talking, yawning, eating, etc. The medial (towards the tympanic membrane) part, a bony region 13 proximal to the tympanic membrane, is rigid due to the underlying bony tissue. The skin 14 in the bony region 13 is thin (relative to the skin 16 in the cartilaginous region) and is more sensitive to touch or pressure. There is a characteristic bend 15 that roughly occurs at the bony-cartilaginous junction 19 (referred to herein as the bony junction), which separates the cartilaginous 11 and the bony 13 regions. The magnitude of this bend varies among individuals.

A cross-sectional view of the typical ear canal 10 (FIG. 2) reveals generally an oval shape and pointed inferiorly (lower side). The long diameter ($D_L$) is along the vertical axis and the short diameter ($D_S$) is along the horizontal axis. These dimensions vary among individuals.

Hair 5 and debris 4 in the ear canal are primarily present in the cartilaginous region 11. Physiologic debris includes cerumen (earwax), sweat, decayed hair, and oils produced by the various glands underneath the skin in the cartilaginous region. Non-physiologic debris consists primarily of environmental particles that enter the ear canal. Canal debris is naturally extruded to the outside of the ear by the process of lateral epithelial cell migration (see e.g., Ballachanda, The Human Ear Canal, Singular Publishing, 1995, pp. 195). There is no cerumen production or hair in the bony part of the ear canal.

The ear canal 10 terminates medially with the tympanic membrane 18. Laterally and external to the ear canal is the concha cavity 2 and the auricle 3, both also cartilaginous. The junction between the concha cavity 2 and the cartilaginous part 11 of the ear canal at the aperture 17 is also defined by a characteristic bend 12 known as the first bend of the ear canal.

First generation hearing devices were primarily of the Behind-The-Ear (BTE) type. However, they have been largely replaced by In-The-Canal (ITC) hearing devices are of which there are three types. In-The-Ear (ITE) devices rest primarily in the concha of the ear and have the disadvantages of being fairly conspicuous to a bystander and relatively bulky to wear. Smaller In-The-Canal (ITC) devices fit partially in the concha and partially in the ear canal and are less visible but still leave a substantial portion of the hearing device exposed. Recently, Completely-In-The-Canal (CIC) hearing devices have come into greater use. These devices fit deep within the ear canal and can be essentially hidden from view from the outside.

In addition to the obvious cosmetic advantages CIC hearing devices provide, they also have several performance advantages that larger, externally mounted devices do not offer. Placing the hearing device deep within the ear canal and proximate to the tympanic membrane (ear drum) improves the frequency response of the device, reduces distortion due to jaw extrusion, reduces the occurrence of the occlusion effect and improves overall sound fidelity.

However despite their advantages, many CIC hearing devices have performance and reliability issues relating to occlusion effects and the exposure of their components to moisture, cerumen, perspiration and other contaminants entering the ear canal (e.g., soap, pool water, etc.). In particular, cerumen infiltration of CIC hearing devices can cause a number of problems with these devices including detrimentally affecting the performance of battery and microphone components. This can occur when the cerumen blocks the air entry ports on the microphone and/or the battery (for metal air batteries). Also, as cerumen accumulates volumetrically, it can absorb water, which then contributes to moisture-related failures.

Attempts have been made to use filters to protect components such as the sound ports of the microphone. However over time, the filters can become clogged with cerumen and other contamination. While U.S. Pat. No. 5,401,920 discloses a cerumen guard that can be replaced, this device requires the user to remove the entire hearing aid from their ear and only protects a small medial portion of the hearing device leaving lateral portions containing the microphone and other assemblies exposed to contamination. Also, the guard increases several dimensions of the hearing device, changing the fit of the device in the canal from that intended by the manufacturer, and is held on only by an adhesive which can detach in the humid environment of the ear canal.

Still other attempts have been made to seal the entire hearing aid to prevent the influx of mixture and cerumen. However such seals can be difficult to reliably form and test as well as reduce acoustic conductance to the hearing aid microphone. Also, many seals can fail over time due to the high humidity environment in the ear canal resulting in liquid water or vapor entering and becoming trapped inside the hearing aid and then condensing. Accordingly, there is a need for improved cerumen protection methodologies for CIC and other hearing aids.

BRIEF SUMMARY OF THE INVENTION

Various embodiments of the invention provide systems, methods and assemblies for improving the long term reliability for extended wear hearing devices such as completely in the canal (CIC) hearing aids. Particular embodiments provide systems, methods and assemblies for the in situ removal of cerumen and other contaminants from CIC and other hearing aids positioned in the ear canal, including hearing aids positioned deep in the ear canal such as the bony portion of the canal.

Many embodiments provide a fitting for in situ removal of cerumen from a hearing device positioned in an ear canal. In these embodiments, the fitting can be grasped and removed from the hearing device without removing the hearing device from the ear canal. In one embodiment the fitting comprises a top portion shaped to be removably coupled to a hearing device component surface and a bottom portion comprising a plurality of leg members extending axially from a perimeter of the top portion. The top portion has a plurality of openings and at least one flexible retaining element configured to releasably engage a retaining feature on the hearing device. The leg members are configured to fit over another surface of the hearing device component such as a side surface. The fitting can be removed from the hearing device component without removing the hearing device from the ear canal. Many embodiments of the fitting include a removal element such as a removal loop that can be engaged by a removal tool. The loop can have a non-deployed state when covered over by another fitting and a deployed state when the other fitting is removed. The loop can have a spring memory to assume the deployed state when the other fitting is removed. The fitting is configured to remove cerumen obstructing a feature on the hearing device component such as an aeration opening.

The fitting is desirably adapted to be removed with a sufficiently low force such the structure of the hearing devices and its position the ear canal are not appreciably disturbed (though some small movement of the hearing device can still occur). Typically, the fitting will be removed by a custom removal tool, but can also be configured to be removed by a tweezers, forceps or like device or even by hand. Such tools engage the removal loop or other removal element to allow the fitting to be grasped and removed in situ in the ear canal. Typically, the fitting is configured to be pulled off by the use of a tensile force, but it can also be configured to be twisted off, or to even release under a compressive force, e.g., by pressing down on the top or sides of the fitting.

In many embodiments, the flexible retaining element is a flexible tab which flexibly deforms in response to the pull or other force so as to release the engagement feature of the hearing device. The retaining elements can include two retaining tabs which are positioned on either side of the retaining feature on the hearing device and can engage a lip on the retaining feature. Typically, the retaining feature will include an insertion handle on the hearing device with an undercut or lip for engaging the retaining tab. The retaining elements can also define portions of the plurality of openings. In one embodiment, the fitting includes two retaining tabs positioned to define a cloverleaf or dog-bone shaped opening with a central opening for engaging the retaining feature and four lobes, at least one of which aligns with an underlying aeration opening of the hearing device.

In many embodiments, the fitting is configured to be mounted over a perforated cap mounted over one or more assemblies of the hearing aid, such as the microphone assembly. The cap includes a plurality of perforations or openings that provide air ingress for one or more of acoustical conduction to the microphone assembly, aeration of interior components of the hearing aid and oxygen supply to a metal-air battery for powering the hearing aid. The top portion of the fitting is mounted over the top portion of the cap and the leg members fit over the sides of the cap. The openings in the top portion of the fitting are desirably aligned with one or more openings of the cap. The leg members desirably exert a spring force against the sides of the cap so as to stay in contact with the cap during movement or deformation of the hearing device in the ear canal. They also have sufficient spring force to prevent migration of cerumen underneath the openings. The spring force can be produced by fabricating the cap from a resilient polymer and configuring the leg members to extend inwardly from the perimeter of the top portion. Typically, the fitting will comprise at least seven leg members which are desirably evenly distributed around the perimeter of the top portion. The leg members are also desirably distributed so as to be radially offset from a leg member of an underlying or overlying fitting. One or more leg members can also be aligned with an underlying opening on the cap such that when the fitting is removed the underlying opening is exposed. The cap will also typically have a centrally placed insertion fitting with an undercut or lip that serves as a retaining feature that is engaged by the flexible tap. Also the cap will typically have one or more radially retaining features, such as retaining pins that engage openings on the fitting to radial retain the fitting on the cap.

In many embodiments, the fitting is configured to be stacked on the cap or other hearing device component such that multiple cerumen removals can be performed. With each removal, adherent cerumen is removed and a fresh unobstructed fitting layer is exposed. A removal can be done at a set wear interval (e.g., two weeks or a month) or can be done whenever the user notices a degradation in performance of the hearing device (e.g., a decrease in volume). Removal can be performed after periods of substantially continuous wear or periods of non-continuous wear. Multiple cerumen removals provides for improved hearing device performance and reliability over periods of extended wear of the hearing device without the need to remove the hearing device from the ear canal. In preferred embodiments, three or more fittings can be configured to be placed in a stacked configuration on the cap. More fittings can be used for periods of longer wear. By using a configuration of staggered leg members described herein, embodiments having stacked fittings can be configured to add little additional diameter to the hearing aid and thus maintain the comfort and fit of the hearing aid.

Another embodiment provides a system for in situ removal of cerumen from a hearing device positioned in the ear canal such as a CIC hearing aid. The system comprises an embodiment of the cerumen removal fitting or other removable layer as well as a removal element and a removal tool configured to engage the removal device and to atraumatically remove the fitting from the hearing device component when the hearing device is inserted deeply in the ear canal of a user.

The removal tool comprises a shaft adapted to be grasped in the hand and a plurality of engagement elements coupled to a first end of the shaft. The engagement elements have a shape and orientation configured to minimize injurious contact with the walls of the ear canal when the removal tool is inserted into the ear canal. The engagement elements can hook or otherwise engage the removal loop by contact or through use of an engagement mechanism that brings the engagement elements into contact with the loop. The configuration of the engagement elements together with the mechanism allows the tool to engage the removal loop independent of the radial orientation of the tool with respect to the hearing device.

In an exemplary embodiment of a method for using the above system, the user inserts the removal tool in the ear canal until the engagement elements make contact with removal loop coupled to a removal fitting or other removable layer. The user then actuates the tool mechanism, engages the removal element of the fitting with the removal tool and then removes the fitting or other removable layer while the hearing device is positioned in the ear canal. Removal can be done for hearing devices positioned in various locations in the ear canal including the bony portion as well as the cartilaginous portion. Also, removal can be done independent of the radial orientation of the removal tool with respect to the hearing device or the ear canal or without precise positioning of the removal tool with respect to the hearing device. Similar methods can be used for embodiments employing other removable fittings and removal tools.

Removal can be done by the hearing aid wearer, but can also be done by the doctor, audiologist or other medical professional. The user can perform multiple removals over a given period. These can be done at set intervals or based upon user perception of hearing aid performance. These and other embodiments and aspects of the invention are described in further detail below.

BRIEF DESCRIPTION OF THE DRAWINGS

FIG. 6B shows the cap with an attached cerumen layer and FIG. 6C shows the removal of the removable layer from the cap.

DETAILED DESCRIPTION OF THE INVENTION

Various embodiments of the invention provide systems, methods and assemblies for improving the resistance of various components hearing devices to moisture, cerumen and other contaminants when the hearing device is worn deep in the ear canal on a long term basis. Many embodiments provide a cerumen removable fitting or layer that allows for the in situ removal of cerumen and other contaminants from a protective cap that fits over portions of the hearing device. Other embodiments provide cerumen removal fittings and layers that provide for in situ cerumen removal from other portions of the hearing device.

Figure 1:
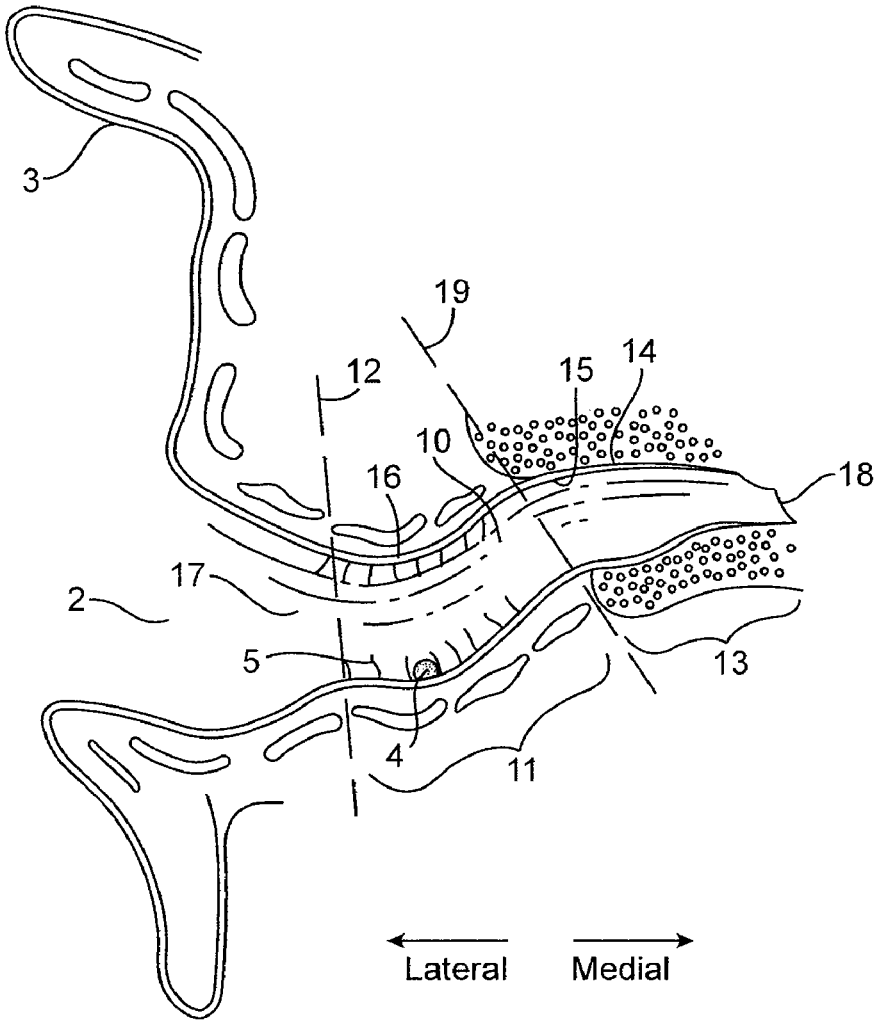
FIG. 1 is a side coronal view of the external ear canal.
Figure 2:
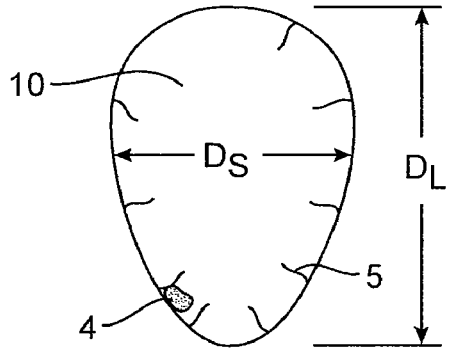
FIG. 2 is a cross-sectional view of the ear canal in the cartilaginous region.
Figure 3:
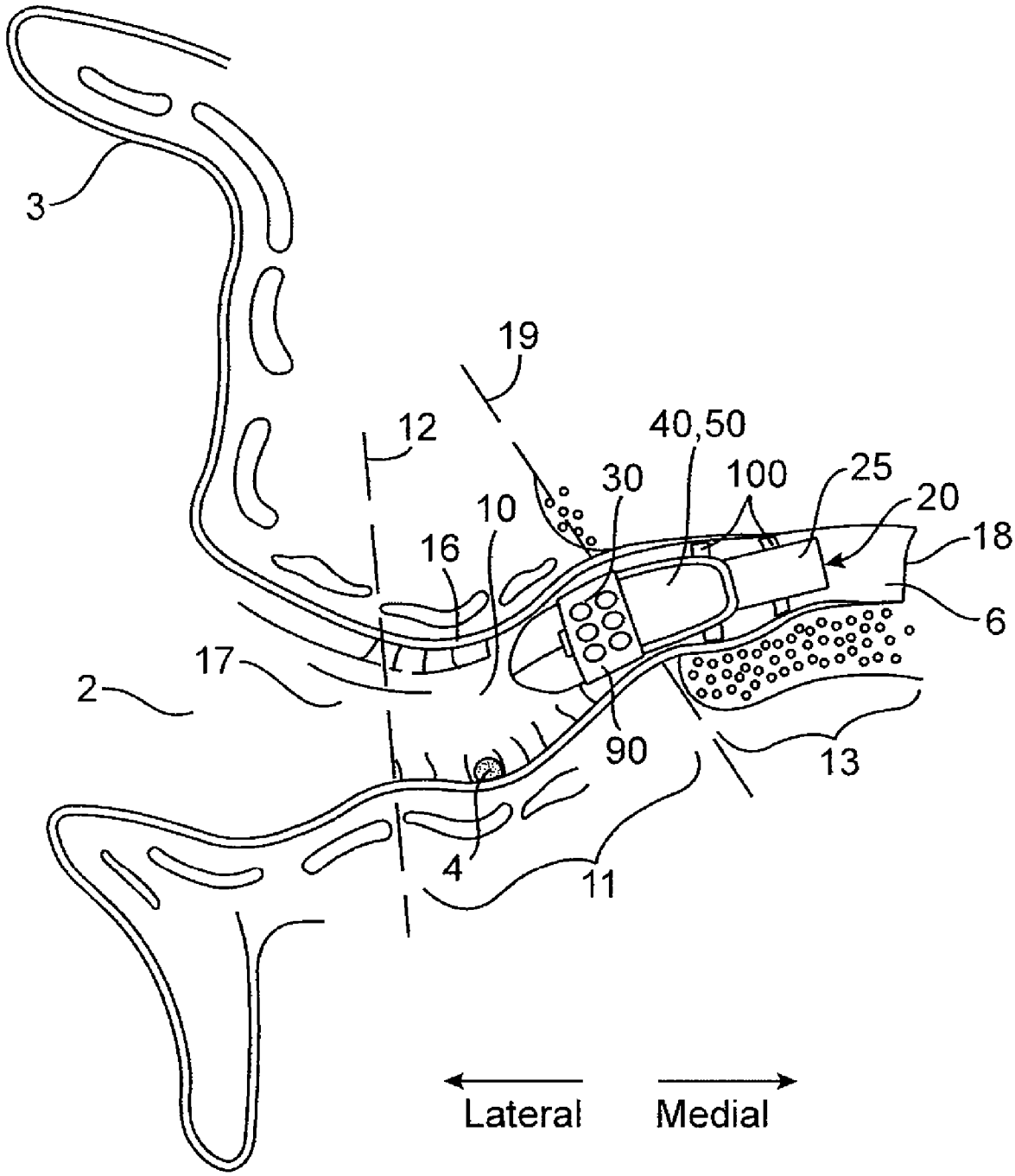
FIG. 3 is a lateral view illustrating an embodiment of a hearing aid device positioned in the bony portion of the ear canal.
Figure 4A:
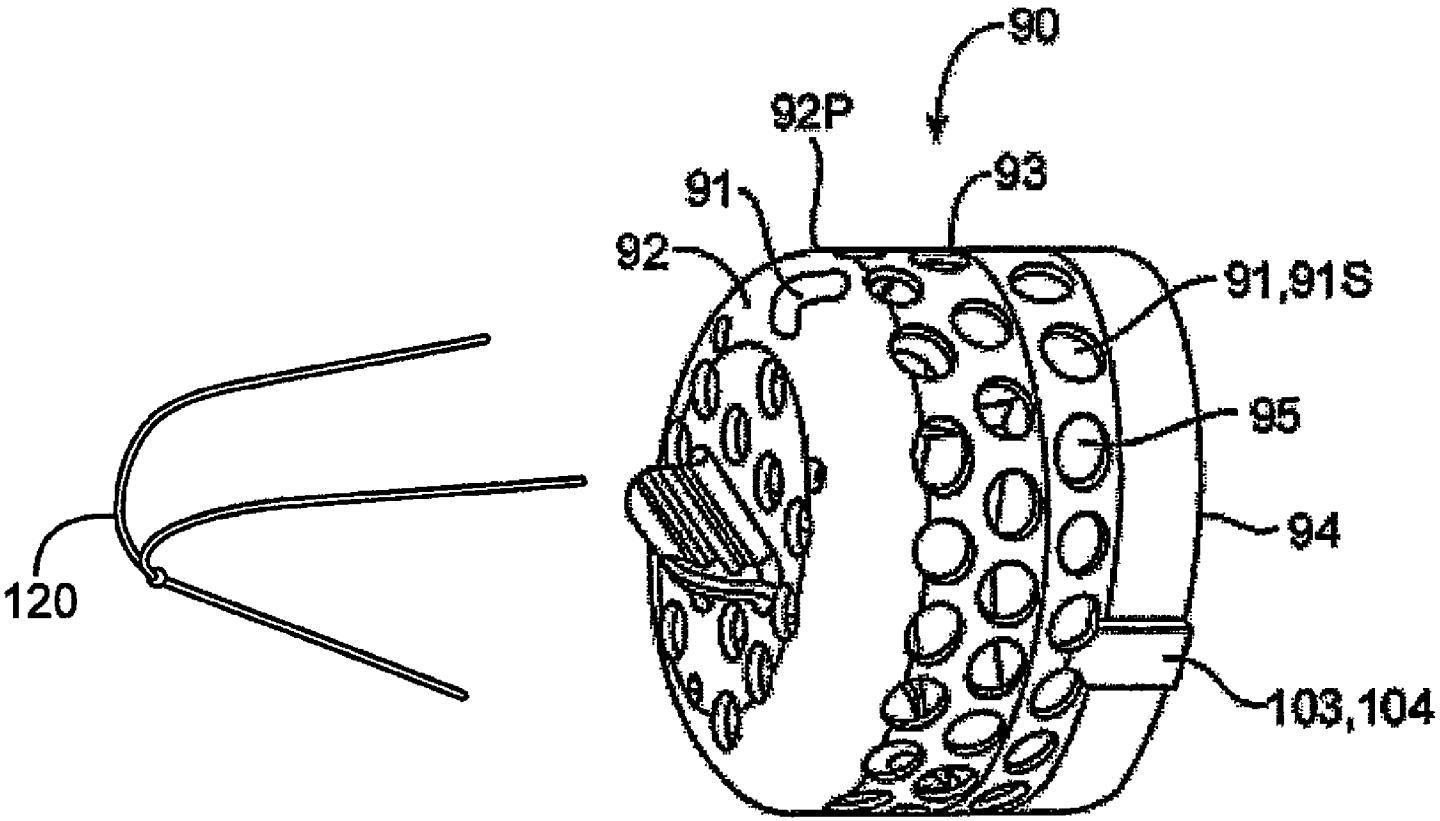
FIG. 4A is a perspective view illustrating an embodiment of the cap assembly including a removal fixture and insertion tabs.
Figure 4B:
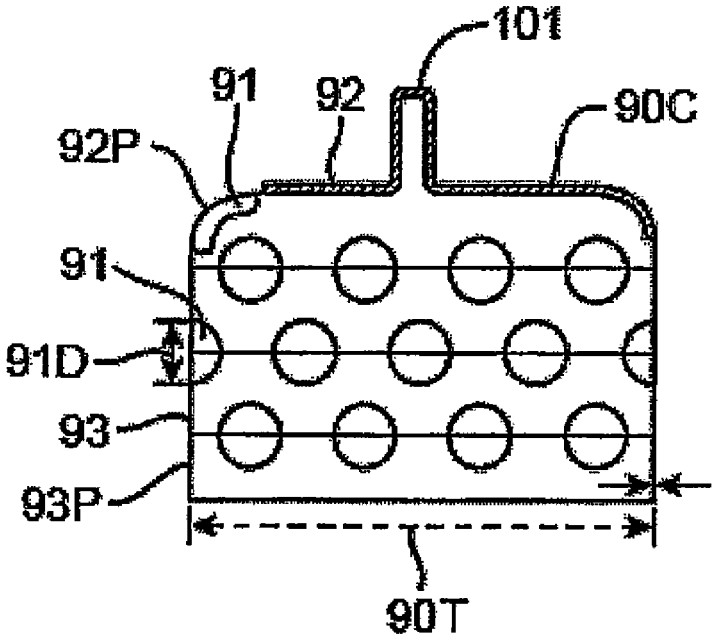
FIG. 4B is a side view of the embodiment of FIG. 4A, illustrating a configuration of the perforations in a row pattern on the sides of the cap assembly.
Figure 4C:
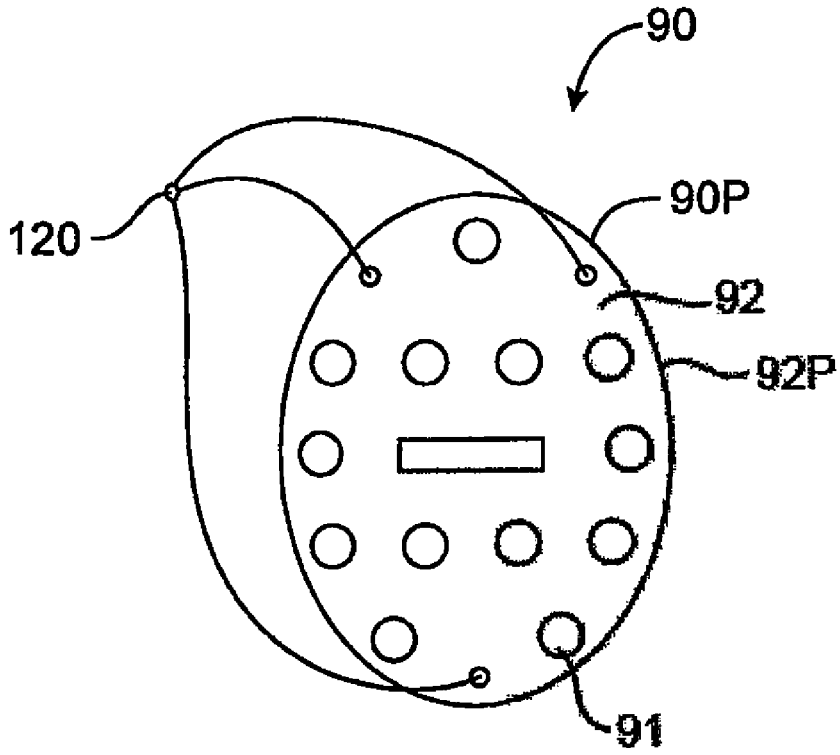
FIG. 4C is a top view of the embodiment of FIG. 4A, illustrating a configuration of the perforations on the top of the cap assembly.
Figure 4D:
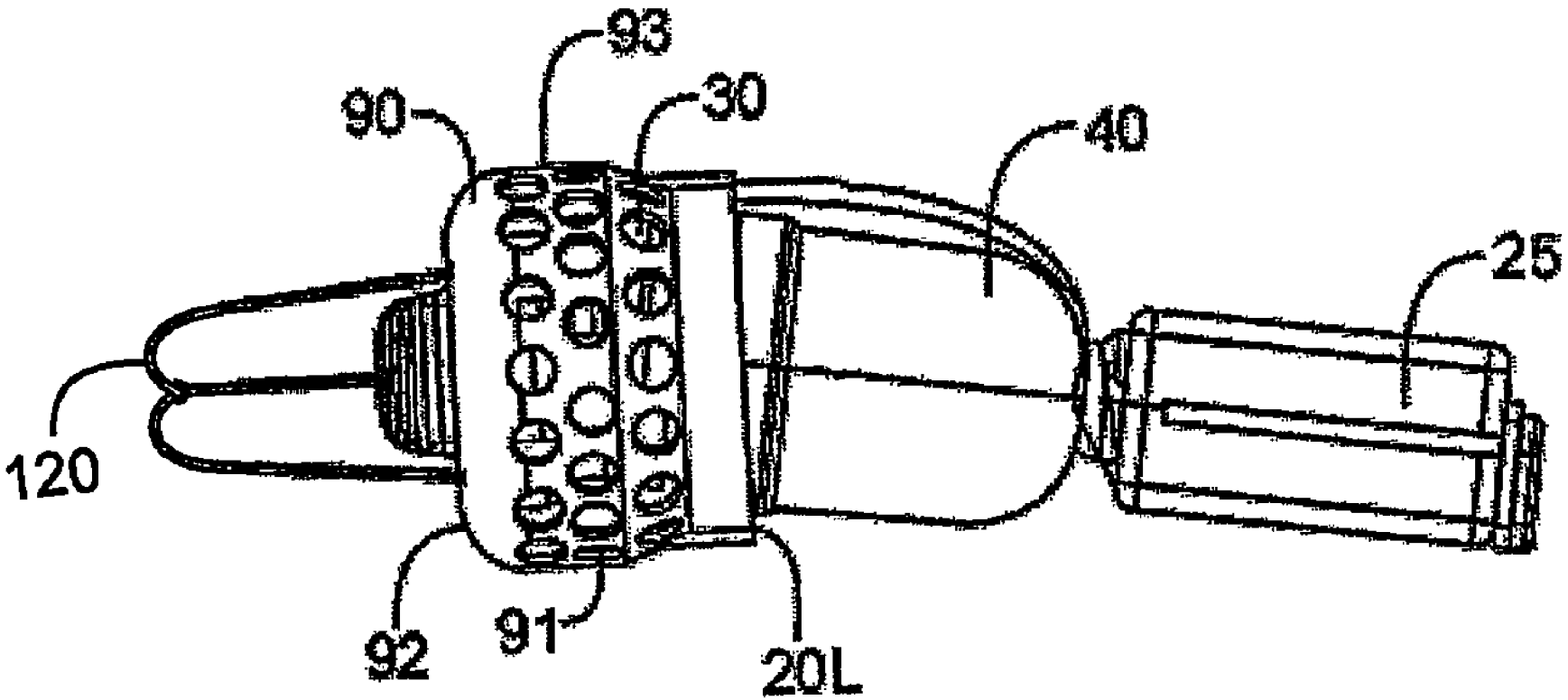
FIG. 4D is a side view illustrating the cap of FIG. 4A positioned onto a hearing aid.
Figure 4E:
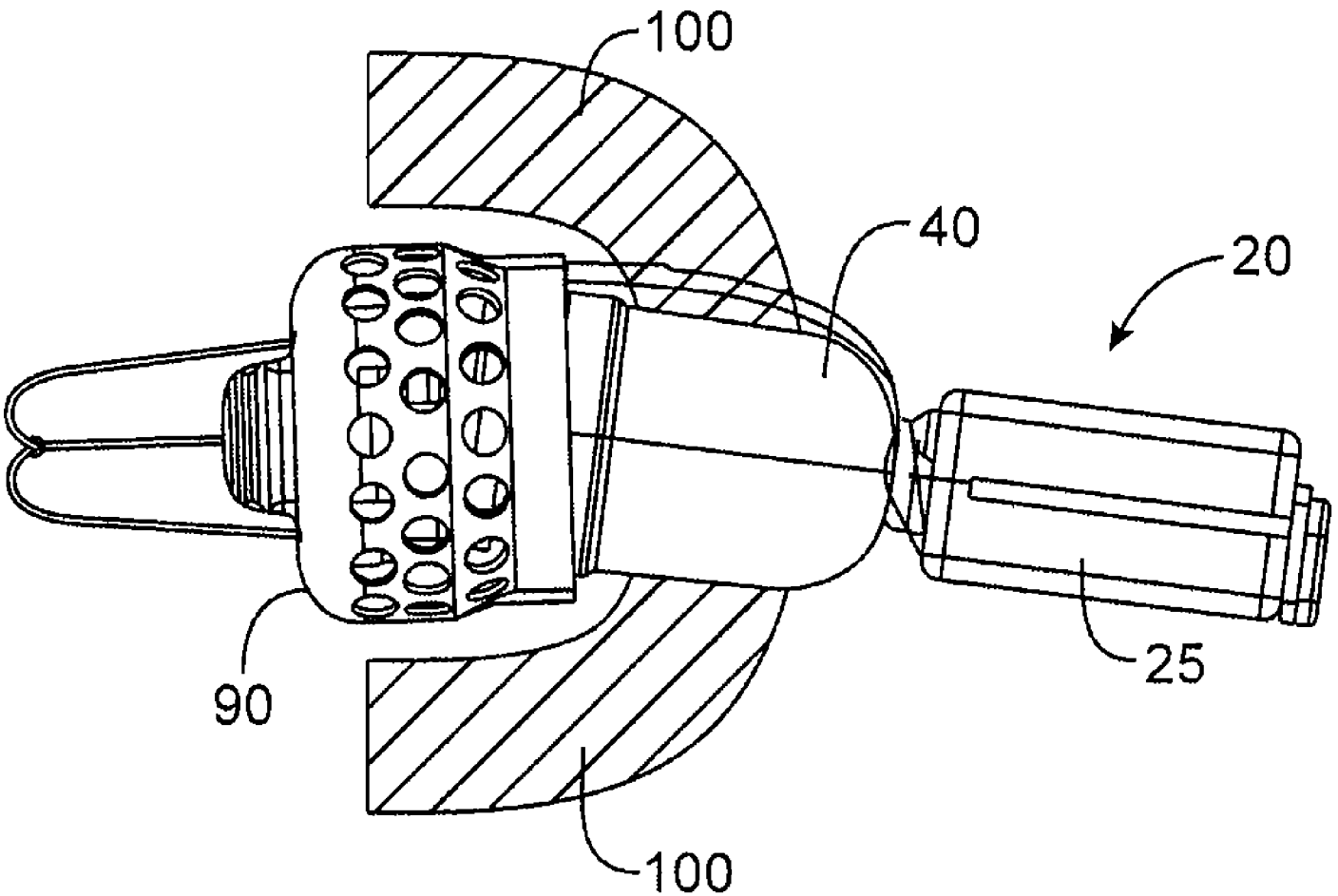
FIG. 4E is a side view illustrating the cap of FIG. 4A positioned onto a hearing aid and seated in a sealing retainer.

As an initial matter, a discussion will now be presented of the configuration of various embodiments of hearing devices and protective caps to which various embodiments of the cerumen removal fittings can be coupled. However, it should be appreciated that embodiments of the cerumen removal fitting and related methods can be employed with other hearing devices not disclosed herein. Referring now to FIGS. 3-4, an embodiment of a hearing device 20 configured for placement and use in ear canal 10 can include a receiver (speaker) assembly 25, a microphone assembly 30, a battery assembly 40, a cap assembly 90 and one or more sealing retainers 100 coaxially positioned with respect to receiver assembly 25 and/or microphone assembly 30. Hearing device 20 can comprise a variety of hearing aids known in the art including ITE, ITC and CIC hearing aids. In many embodiments, hearing device 20 is a CIC hearing aid and for ease of discussion will often be referred to as such. However, other hearing device described herein or known in the art are equally applicable.

Receiver assembly 25 is configured to supply acoustical signals received from the microphone assembly to a tympanic membrane of the wearer of the device. Battery assembly 40 includes a battery 50, and can also include a battery barrier 60 and a battery manifold 70. Preferably, device 20 is configured for placement and use in the bony region 13 of canal 10 so as to minimize acoustic occlusion effects due to residual volume 6 of air in the ear canal between device 20 and tympanic membrane 18. The occlusion effects are inversely proportion to residual volume 6; therefore, they can be minimized by placement of device 20 in the bony region 13 so as to minimize volume 6. Preferably, device 20 is also configured for extended wear in ear canal 10. In specific embodiments, hearing device 20 including a protective cap 90, can be configured to be worn continuously in the ear canal, including the bony portion, for 3 months, 6 months or even longer.

Referring now to FIGS. 4-5, a discussion will be presented of protective cap 90. The cap can be configured to be mounted over or otherwise coupled to at a lateral end 20L of hearing device 20. In many embodiments, the cap will be configured to mount over most or all of microphone assembly 30. However, the cap can also be configured to be mounted over portions of battery assembly 40 and even portions of receiver assembly 25. In a preferred embodiment, the cap is configured to mount over all of microphone assembly 30 and a portion of battery assembly 40. In particular embodiments, the cap can be configured to mount over and form a seal 41 with one or more components of battery assembly 40 such as a battery barrier 60 and/or a battery manifold 70. The cap can also be configured to be seated in or otherwise coaxially coupled to sealing retainer 100.

The cap can have a variety of shapes including, but not limited to, cylindrical, semi-spherical and thimble shaped. In a preferred embodiment, the cap is substantially cylindrically shaped and includes a top portion 92 and a side wall portion 93 and interior or cavity portion 95. Side wall portion 93 defines an open medial portion or opening 94 to cavity portion 95. Opening 94 serves as a conduit for mounting the cap over various portions and/or components of hearing aid 20. The thickness of 90T of side 93 and/or top 92 can be in the range of about 0.001 to about 0.010 inches. Preferably thickness 90T is less than about 0.010 inches and more preferably less than about 0.050 inches. In many embodiments, the cap includes one or more perforations or openings 91 which can be configured to perform one or more functions including, without limitation, serving as channels for: i) ventilation for moisture reduction; ii) oxygen supply to the battery; and iii) acoustic conduction to microphone as is discussed herein. Perforations 91 can be positioned in various locations throughout the cap but are preferentially positioned in patterns on the top and sides of the cap. In embodiments in which the cap is seated in a sealing retainer 100, at least a portion of perforations 91 are preferentially placed on the cap so as not be obstructed by the sealing retainer. Also, as is described herein, all or portions of cap 90 can include a protective coating 90*c*, such as a hydrophobic coating.

Figure 5A:
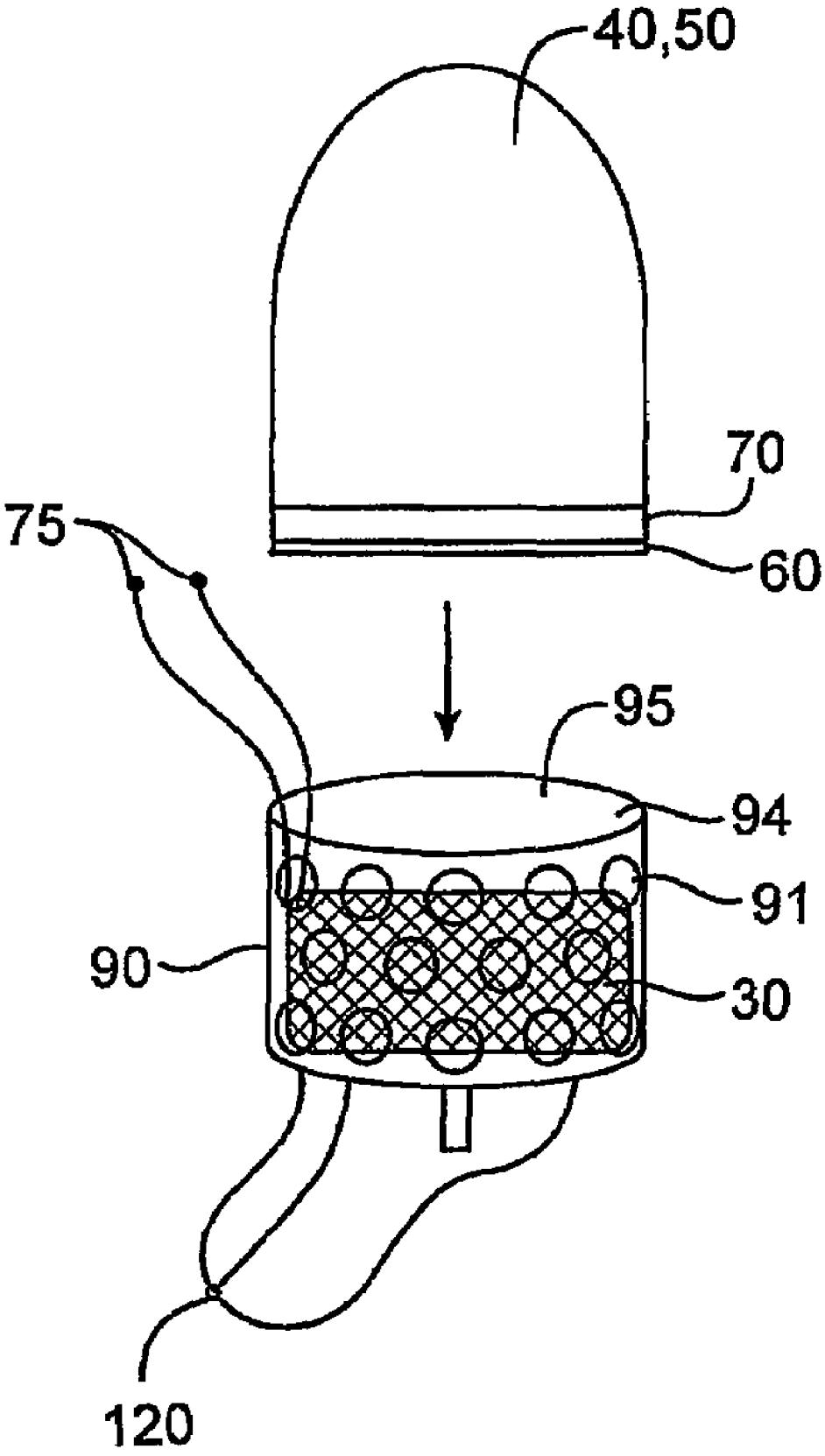
FIG. 5A is a side view illustrating the assembly of an embodiment of the cap assembly onto a hearing aid.
Figure 5B:
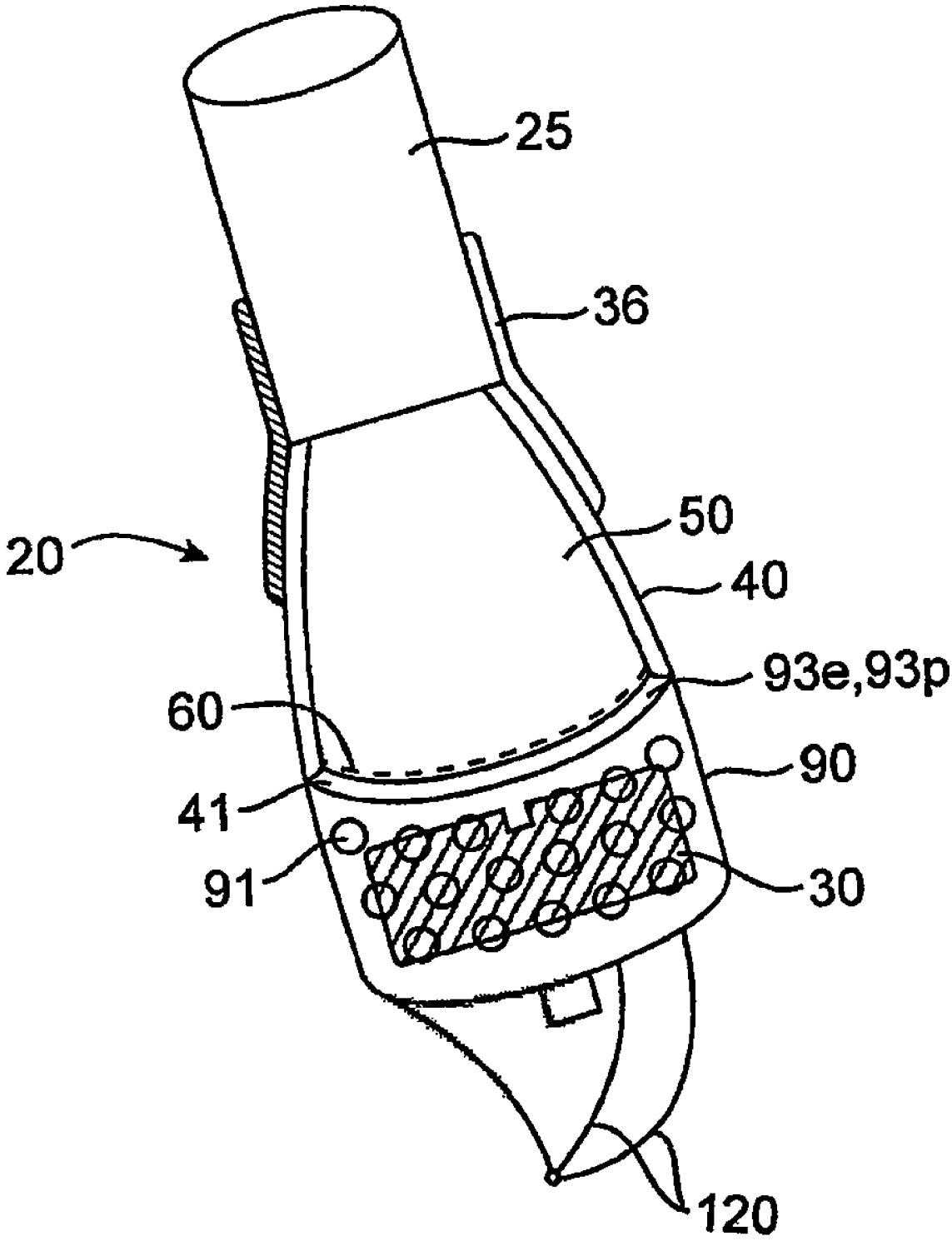
FIG. 5B is a perspective view illustrating the cap assembly of FIG. 5A assembled onto a hearing aid.

In many embodiments, the cap interior 95 has a sufficient volume and shape to serve as a receptacle for various components of hearing aid 20 including, but not limited to, microphone assembly 30 and associated integrated circuit assemblies, battery assembly 40, battery barrier or 60, battery manifold 70, receiver assembly 25 and electrical harnesses or connections 75 for one or more hearing aid components (see FIGS. 5A-5B). After the component or components are placed within the cap interior 95, a setting or encapsulation material can be added. In a preferred embodiment, the cap is configured to serve as a receptacle to the microphone assembly when the microphone is oriented in a medial direction of the ear canal. In such embodiments, the cap is also configured to provide sufficient acoustic transmittance to the microphone assembly such that the hearing aid provides adequate function to the user (e.g., amplification, frequency response, etc). The cap can also be configured to coupled to or form a seal with a flexible coupling or joint 36 coupling one or more components of the hearing aid such as the receiver assembly 25 and the battery assembly 40. In one embodiment, the flexible coupling 36 can comprise elastomeric tubing (e.g., silicone or polyurethane tubing). The elastomeric tubing can be positioned over a portion of the cap and also hold it in place on the hearing aid by a circumferential spring force. Also, the elastomeric tubing can be configured to fit under the side portion 93 of the cap. A perimeter portion 93*p* of the side portion of the cap can itself include an elastic portion 93*e* configured to have sufficient elasticity to fit over and grip the battery assembly 40 (which can be covered by elastomeric tubing 36) with circumferential force so as to form a seal 41 with a portion of the battery assembly. Seal 41 can be watertight or even an air tight seal.

Figure 6A:
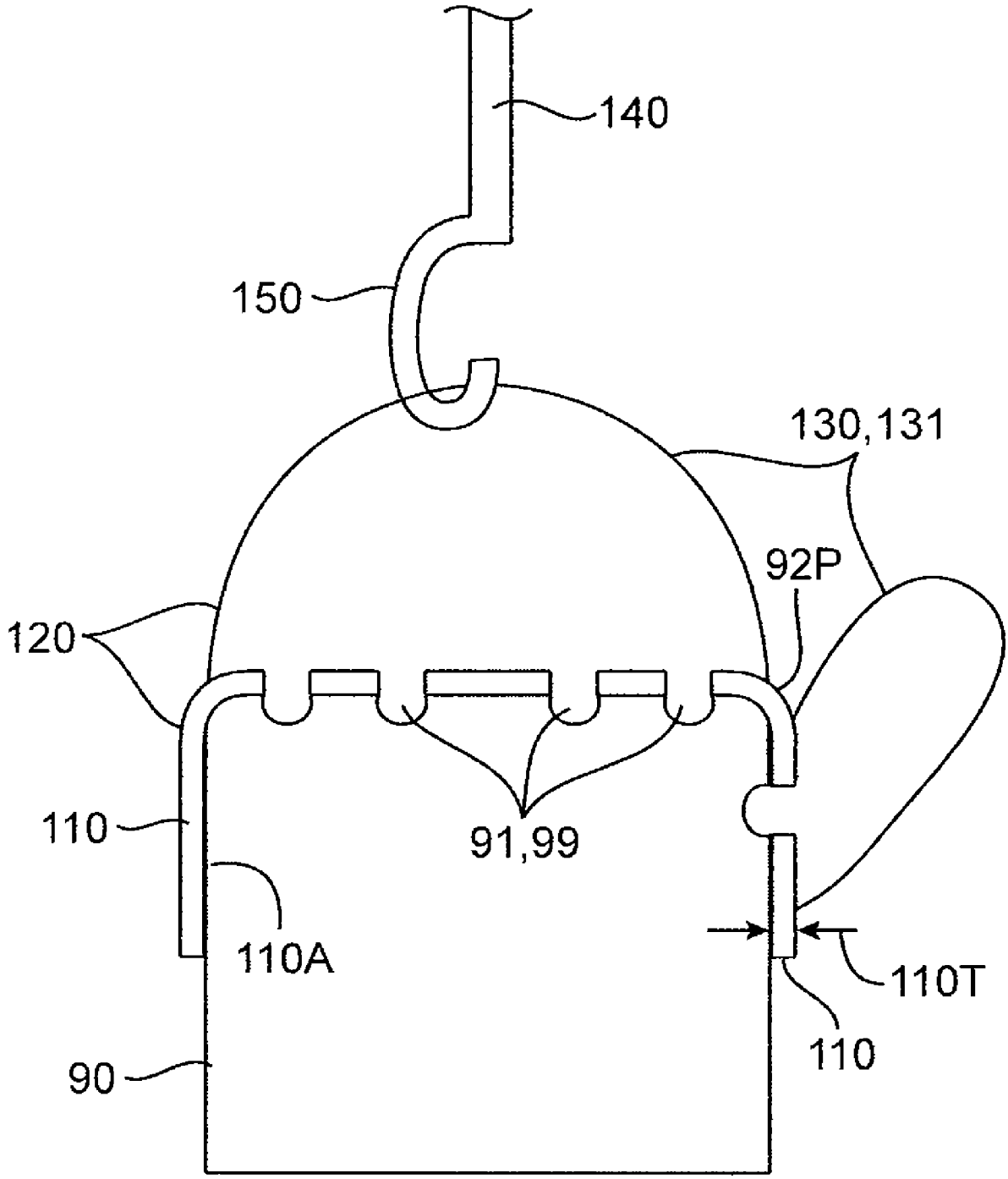
FIG. 6A is a side view illustrating an embodiment of the cap assembly including a peelable layer.
Figure 6B:
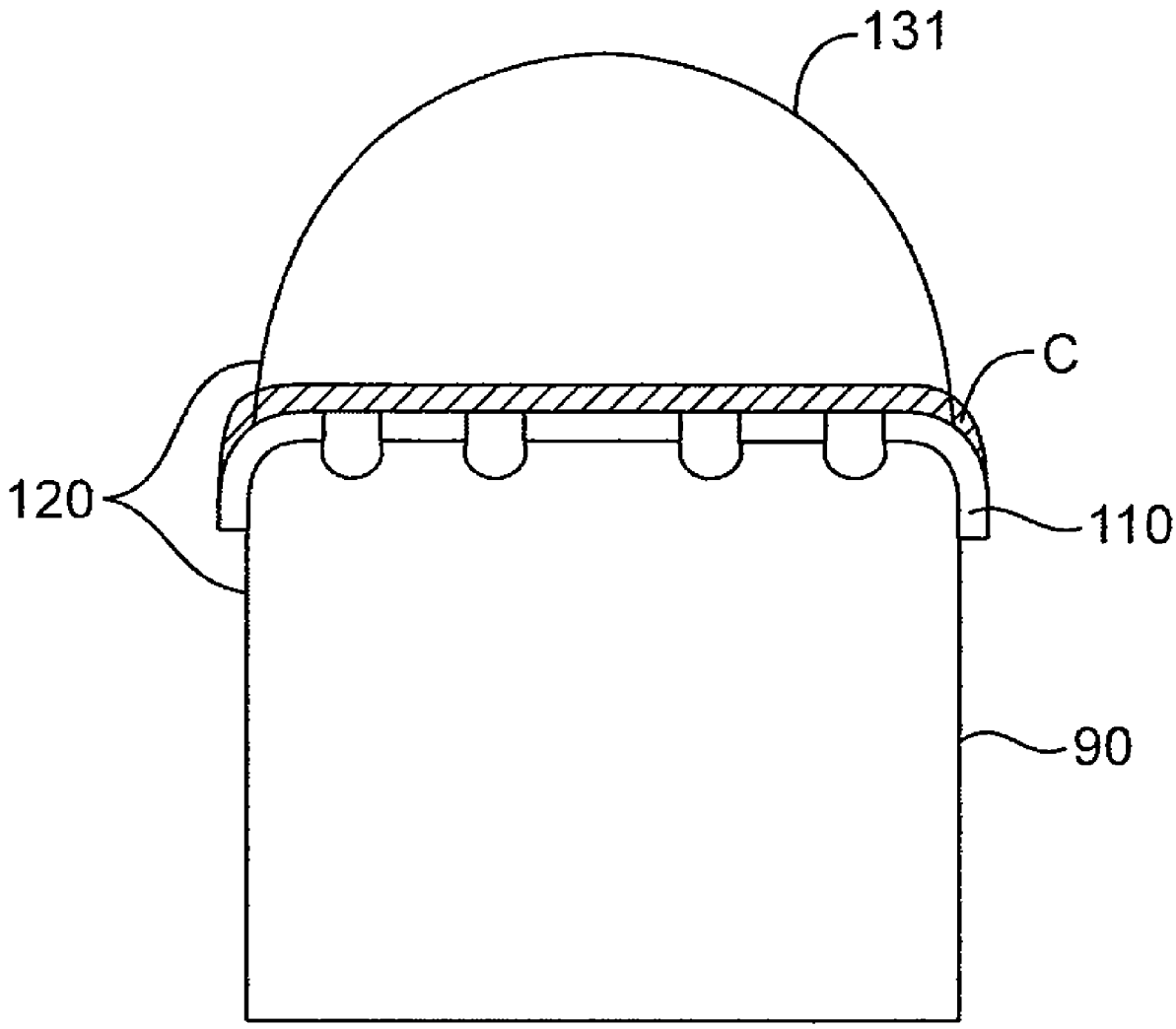
FIGS. 6B and 6C are side views illustrating use the of an embodiment of the cap assembly including a removable layer.
Figure 6C:
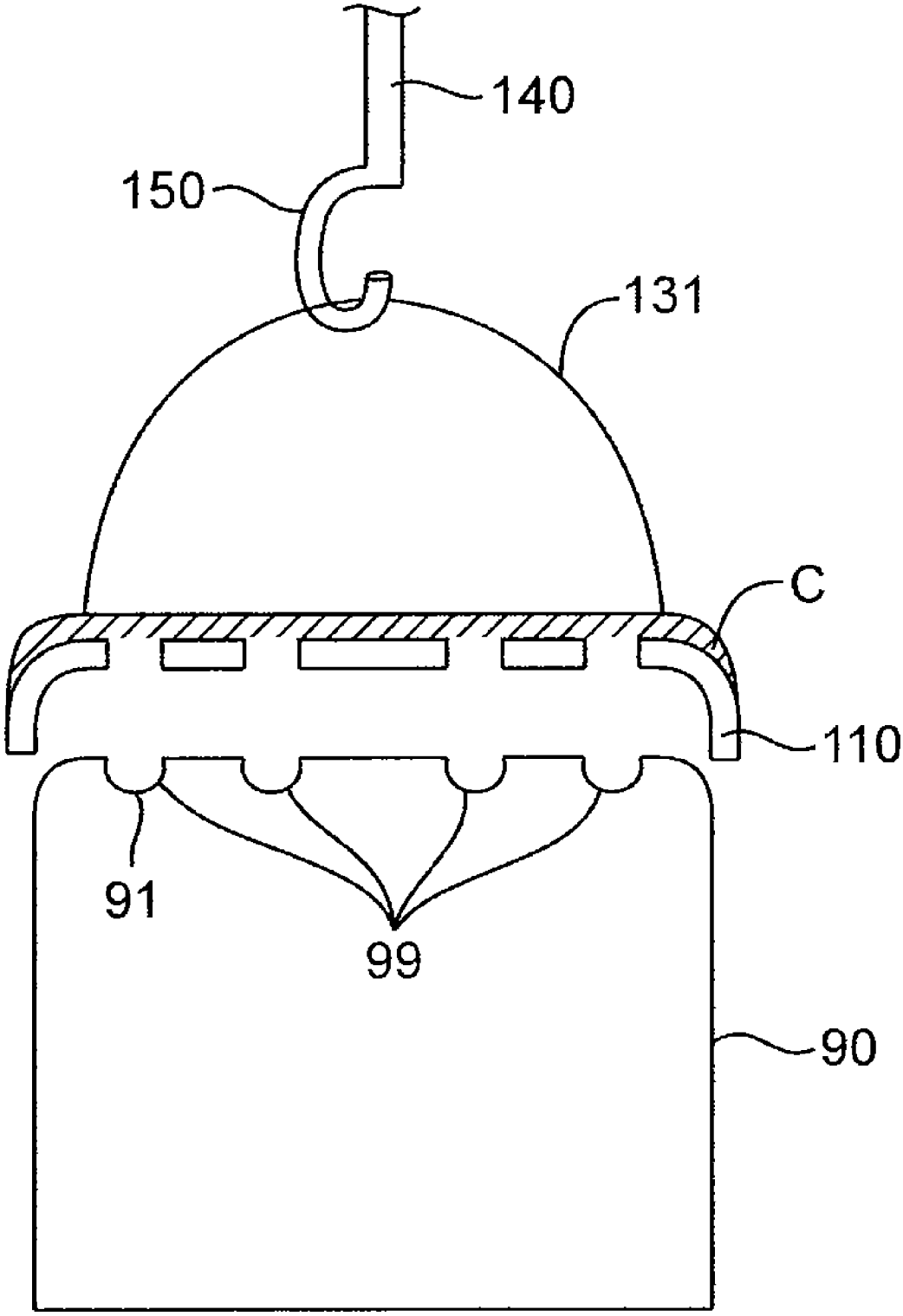
Figure 7:
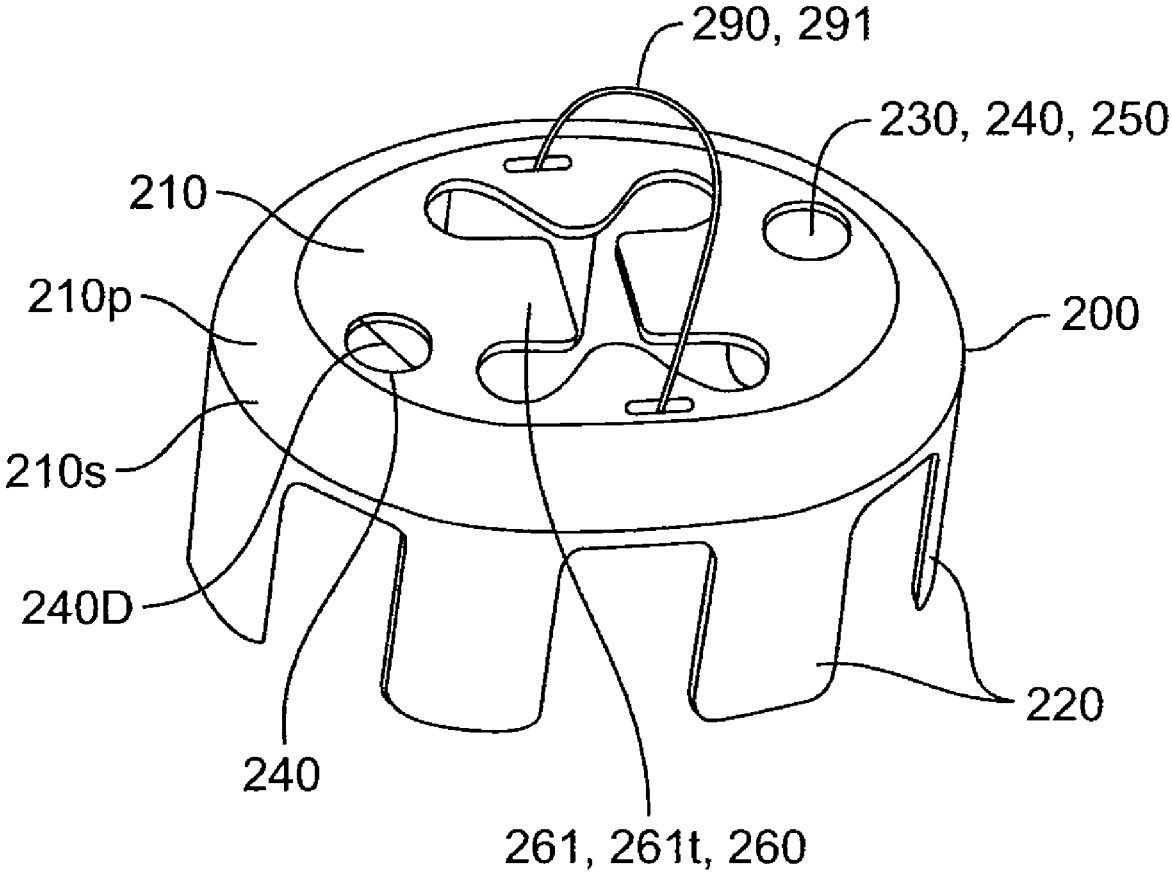
FIG. 7 is an isometric view illustrating an embodiment of the removable fitting having a top portion and leg members.

Referring now to FIGS. 6A-6C, in various embodiments, the cap can include one or more removable layers 110 attached to all or selectable portions of the cap. In one embodiment, removable layer 110 comprises a peelable layer held on via an adhesive as described below. In various other embodiments, removable layer 110 can be removed via use of deformable tabs, or other releasable attachment means known in the art. Preferably, layer 110 covers at least the perforated portions of the cap. In one embodiment, the entire surface of the cap 90 is covered by a removable layer, in another, just the top portion 92. Also, each layer 110 can be configured to reveal new perforation 91. New perforations 91 can substantially align with one or more perforations of an overlying layer 110. Alternatively perforations 91 can comprise an entirely different set of perforations with a new pattern 99 than that of an overlying layer.

In most embodiments, each removable layer includes an attached removal loop 131 or other removal means 130 that allows in situ removal of the layer by a user or medical worker using a removal tool 140 that has one or more hooks or other grasping means 150 for engaging loop 131. Other removal means can include an adhesive member, a VELCRO member, a magnetic member, a suction cup or vacuum source, and the like. The removable layer together with the removal means 130 are configured to function as an in situ cerumen removal system 120 such that when the layer is removed (e.g., by peeling) adhered cerumen C and other contaminants are removed along with layer 110, including cerumen or other contaminants that are blocking the perforations 91. Also a fresh region of the cap is revealed. In use, such a system allows a user to clean their hearing aid without undergoing the inconvenience of removing the hearing aid from their ear canal.

In one embodiment, removal means 130 comprises one or more suture loops 131 threaded through of more perforations 91 or attached to layer 110 by an adhesive means. Loops 131 can be positioned at various locations on layer 110/cap 90. One or more loops 131 can be attached centrally on cap top 92, near the perimeter 92P of cap or on the cap sides 93. The specific placement of loops 131 can be selected depending upon the one or more aspects of layers 110 such as its shape, thickness, perforation pattern 99 and similar factors.

In various embodiments, the thickness 110T of a given peelable or other removable layer 110 can be in the range of 0.001" to about 0.006", with a specific embodiment of 0.003". Other thickness can also be used. The particular thickness can be selected depending a variety of factors including the number of layers to be stacked on the hearing device, the size and shape of the hearing device and the desired release force for removing a given layer and desired flexibility of a given layer.

Also different layers can have different thicknesses. For example, the top layer can be thicker or thinner than underlying layers.

In various embodiments the materials for layer 110 can be selected depending on the desired properties for the layer. Preferably, removable layer 110 is fabricated from a material that has one or more of the following properties: water resistance, cerumen resistance, dimensional stability and is machinable. Layer 110 can comprise various polymeric materials having one or more of these properties. In one embodiment, layer 110 comprises a rigid vinyl plastic. Copolymers of this material can also be employed. Other like polymers and copolymers can also be used.

The cap can include multiple peelable or other removable layers 110 such that multiple cerumen removing peals can be done over a period of extended wear of the hearing aid in the ear canal. In various embodiments, cap 90 can include between 2 to 10 layers, with a specific embodiment of 3 layers. Peels or other removals can be done at set time intervals (e.g. monthly) or whenever the user notices a perceptible degradation in performance of the hearing aid (e.g. decreased volume, clarity sound recognition, etc.). In this way, the user can wear the hearing aid for extended periods of time without degradation in performance due to cerumen or other contaminant build up and without having to undergo the inconvenience of removing the hearing aid for purposes of cleaning. In one embodiment, the hearing aid can be configured to detect degradations in performance due to cerumen fouling and provide an audible alarm or other signal to alert the user when to do a removal (e.g. pealing) procedure. This can be accomplished through the use of one or more software programs or modules resident within memory or logic resources integral or coupled to the hearing aid. The specific threshold for a removal signal can be set at the factory or can be selected by the user or health professional.

Referring now to FIGS. 7-14, other embodiments of a cerumen removal system 120 will now be discussed. In various embodiments, removal system 120 can include a removable fitting 200 configured to be mounted or otherwise coupled to cap 90 or other portion of hearing aid 20. Desirably, the fitting is configured to be grasp and removed from the cap 90 while hearing aid 20 is still in the ear canal. This can be accomplished by hand or using a tool such as a tweezers or a custom removal tool.

The fitting 200 can have a shape corresponding to the shape of at least a portion of cap 90 so as to facilitate mounting and removal from the cap. Suitable shapes include dome, semicylindrical or crown shaped; however other shapes are equally applicable. In a preferred embodiment, the fitting has a crown shape so as to irremovably mounted to the top and sides of cap 90. Also, all or a portion of the fitting can be made of a conformable material to so as to conform to the shape of cap 90 or other portions of hearing aid 20.

In many embodiments, the fitting is shaped or otherwise configured to be stacked on the cap so that a plurality of fittings 200*p* can positioned on the cap to allow for multiple fitting removals and thus multiple sheddings of adherent cerumen layers. For example in the embodiment shown in FIG. 11, fittings 200*p* can a include an upper fitting 200, a first underlying fitting 200', and a second underlying fitting 200". In preferred embodiments, three or more fittings are placed in a stacked configuration on the cap. More fittings can be used if so desired, for examples, for periods of extended wear. The leg members in sets of fittings can also be staggered such that the leg member of an under-lying fittings are offset from those of an overlying fitting. For example1 a leg member 220 of a fitting 200 can be offset from the leg member 220' of a first underlying fitting 200 which in turn is offset from the leg member 220" of a second underlying fitting 200". By using a configuration of staggered leg members, embodiments having stacked fittings can be configured to add little additional diameter to the hearing aid and thus maintain the comfort and fit of the hearing aid in the ear canal. In various embodiments, stacked fittings can be pre-packaged separately as a stacked set (e.g., in numbers of 3, 5, 7 etc.) and then mounted to cap by the user or health care provider before insertion. Thus, the user can select the number of fittings to be used for their individual hearing aid. Also after the last fitting has been removed from the hearing aid, the user can remove the hearing aid from their ear and mount a new set of stacked fittings onto the hearing aid. In this way, the usable life of the hearing aid can be extended.

In various embodiments, the fitting comprises a top portion 210, a bottom portion 220 and a removal element 290 for grasping and removing the fitting. Typically, the bottom portion comprises a plurality of leg members 220 that extend axially from the top portion and are radially distributed around the perimeter 210*p*. Removal element 290 can comprise a loop or other graspable feature and will typically be attached to top portion 210 but can also be attached to another part of the fitting. The fitting can be fabricated from a variety of biocompatible materials including metals and various high modulus polymers known in the art. In specific embodiments, all or a portion of the fitting can be fabricated from PEEK, PETG, and polyetherketone (an example of the later including ULTEM). Fabrication methods which can be used to make the fitting include injection molding, machining, laser cutting, stamping and die-cutting. In one or more of these methods, the fitting can be fabricated as a planer sheet of a malleable material (e.g., plastic or metal) with the top portion 210 in the same plane as leg members 220. Then, the leg members can be bent or otherwise shaped into position relative to the top portion 210 to form the shape 210*s* of the fitting. In one embodiment, this can be accomplished by vacuum forming the fitting onto the cap or tooling representing the cap using vacuum forming methods known in the art.

The top portion 210 will typically have a shape 210*s* corresponding at least in part to shape of the top portion 92 of cap 90. Top portion 210 also has plurality of openings 230. Openings 230 will typically include one or more aeration openings or perforations 240 which can be at least partially aligned with one or more openings 91 and have a shape and size similar to openings 91. Openings 230 can also include one or more retaining openings 250 discussed below.

Leg members 220 can be configured to perform several different functions. They desirably exert a spring force against the sides of cap so as to stay in contact with the cap during movement or deformation of the hearing aid in the ear canal. They also desirably exert sufficient spring force to prevent migration of cerumen underneath the leg members or other portions of the fitting. Selected amounts of spring force can be produced by fabricating the fitting from a resilient polymer and configuring the leg members to extend inwardly from the perimeter of the top portion so that they are partially deformed when they are positioned over the cap. In this respect, they can function as a plurality of leaf springs. Typically, the fitting 210 will include at least seven leg members, though lesser numbers are equally suitable (e.g., three, four, five or six members). They can be can be evenly distributed around the perimeter 210*p* of top portion 210 or distributed in other patterns. The leg members of a given fitting 200 are also desirably distributed so as to be radially offset from a leg member of an underlying or overlying fitting. One or more leg members can also be aligned with an underlying opening (e.g., openings 240 or 91) on an underlying fitting 210 or cap 90 such that when the fitting is removed the underlying opening is exposed. In other embodiments bottom portion 220 can comprise other configurations besides a leg member, such as a cylinder, or band, that can perform the same functions as the leg members.

Aeration openings 240 can have a circular shape with a diameter 240D corresponding to the diameter 91D of openings 91. Similar to openings 91, openings 240 can a have a minimum diameter such that only a single opening 240 provides sufficient acoustic transmittance to the microphone, or other hearing aid component, such that a hearing aid performance parameter is not substantially adversely affected. Such parameters can include, without limitation, the output, volume, gain, frequency response of the hearing aid as well as battery life or battery voltage. The minimum diameter 240D of the openings 240 can range from about 0.01 to about 0.05 inches, with a preferred embodiment of 0.025 inches.

The fitting can be retained on the cap or other portion of the hearing aid through a variety of retaining means including mechanical and adhesive retaining means. In many embodiments, the fitting will include one or more retaining elements 260 which are configured to engage one or more retaining features 270 on the cap 90 or other portion of the hearing aid 20. Typically, the retaining feature 270 will be located on the top portion of the cap (with mating retaining elements 260 positioned on top portion 220), but can also be positioned on the sides as well. Retaining features 270 can include primary retaining features 271 and secondary retaining features 272 which are in turn are configured to engage primary and secondary retaining elements 261 and 262. Primary features 271 serve to vertically retain the fining on the cap so as to prevent the fining from detaching. Secondary retaining features 272 serve to radially retain the fitting on the cap to prevent radial or other side to side motion of the fitting on the cap. In this respect, secondary retaining features 272 serve as keying feature 272 to provide positional stability of the fitting on the cap.

In various embodiments, the retaining elements such as the primary retaining elements are flexible and released from engagement with retaining feature by the application of a force which flexes or otherwise deforms the retaining elements. In particular embodiments, fitting 200 can have primary retaining elements 261 that comprise one or more flexible tabs 261*t* that engages with a primary retaining feature 271 on the cap 90. Typically, the retaining feature 271 will comprise an insertion features 273 on cap 90 with one or more undercuts or lips 274 for engaging the tab. When a pull force is exerted on fitting 200, tabs 261*t* flex and release from lip 274 to in turn, releasing the fitting.

Figure 8:
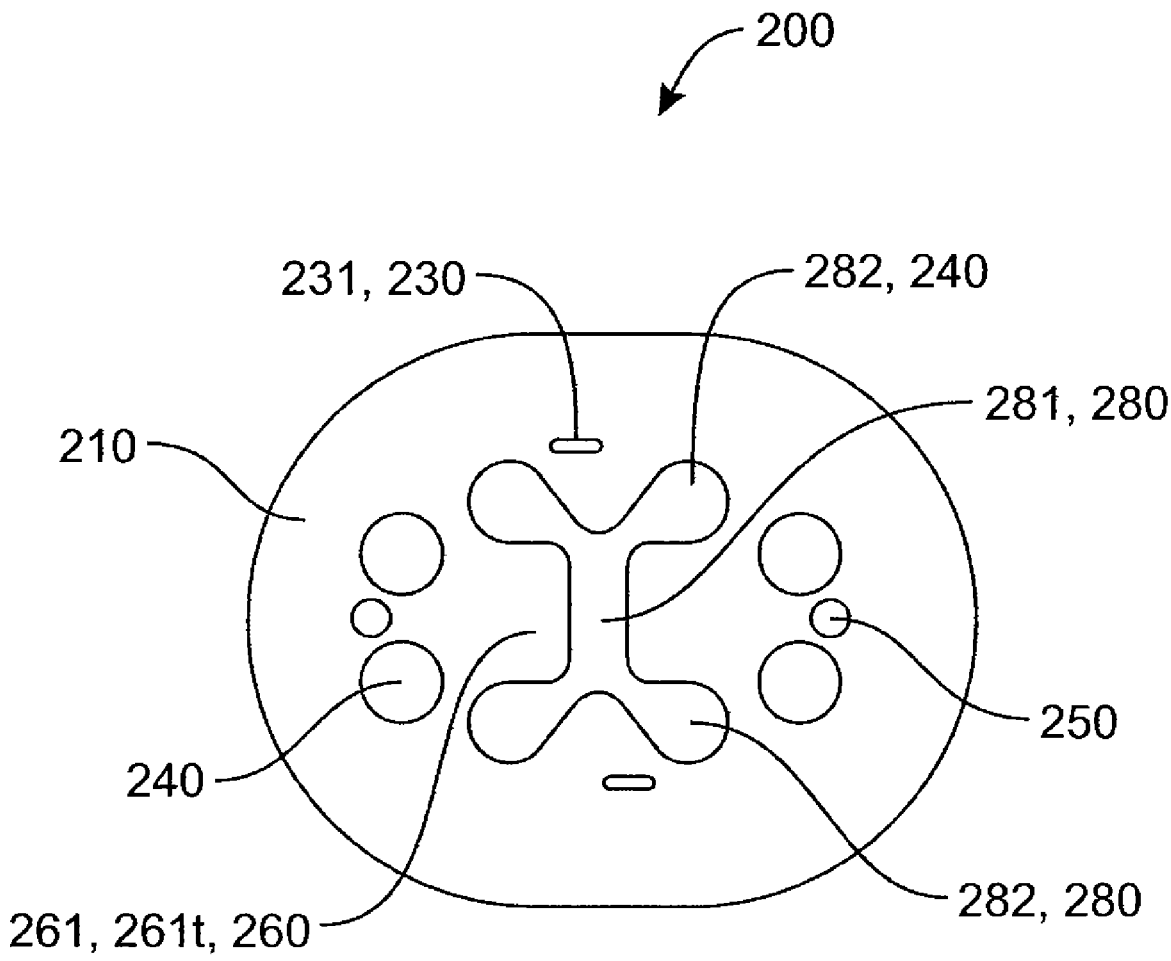
FIG. 8 is a top down view illustrating the top portion of the embodiment of the fitting of FIG. 7.
Figure 9:
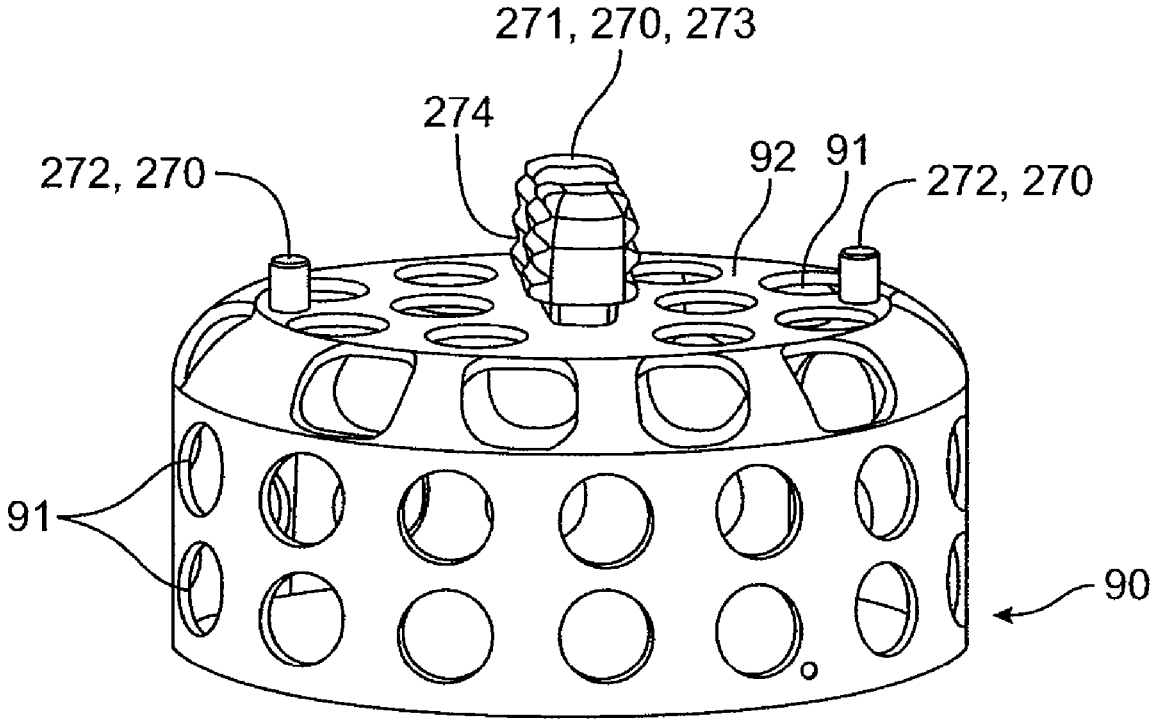
FIG. 9 is an isometric view of a hearing aid cap configured to be overlaid with one or more removable fittings.
Figure 10:
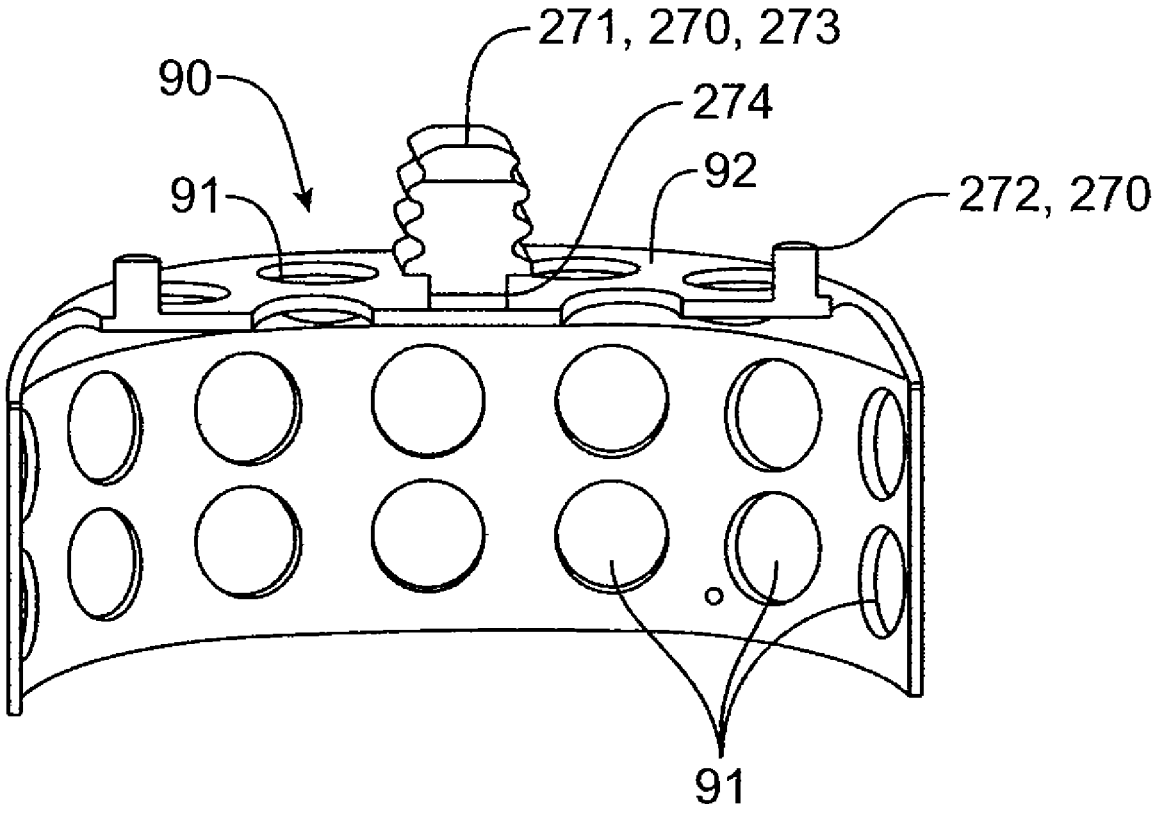
FIG. 10 is a cutaway isometric view of the embodiment of FIG. 9.
Figure 11:
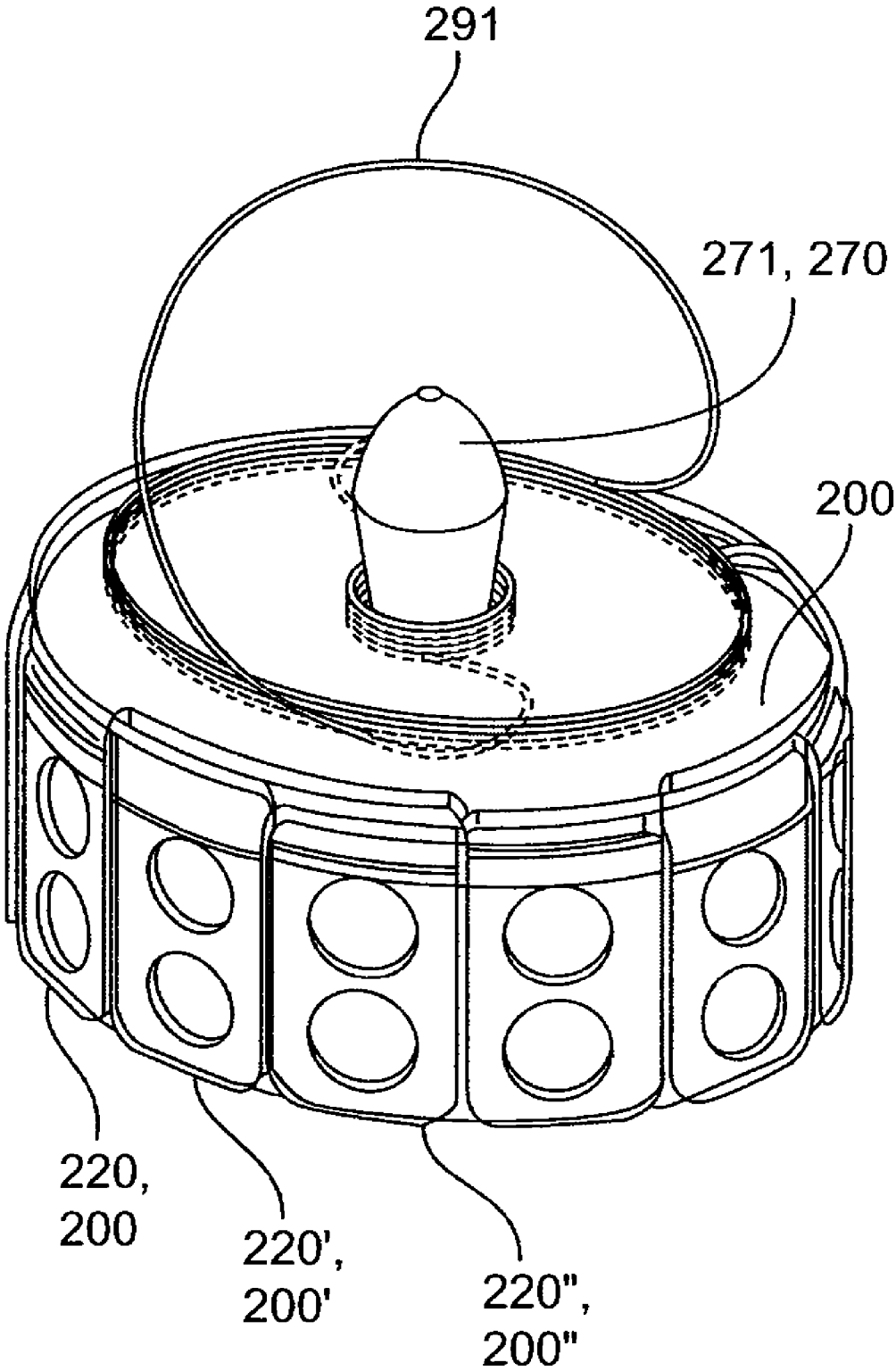
FIG. 11 is an isometric view of the a hearing aid cap with multiple attached removable fittings.
Figure 12:
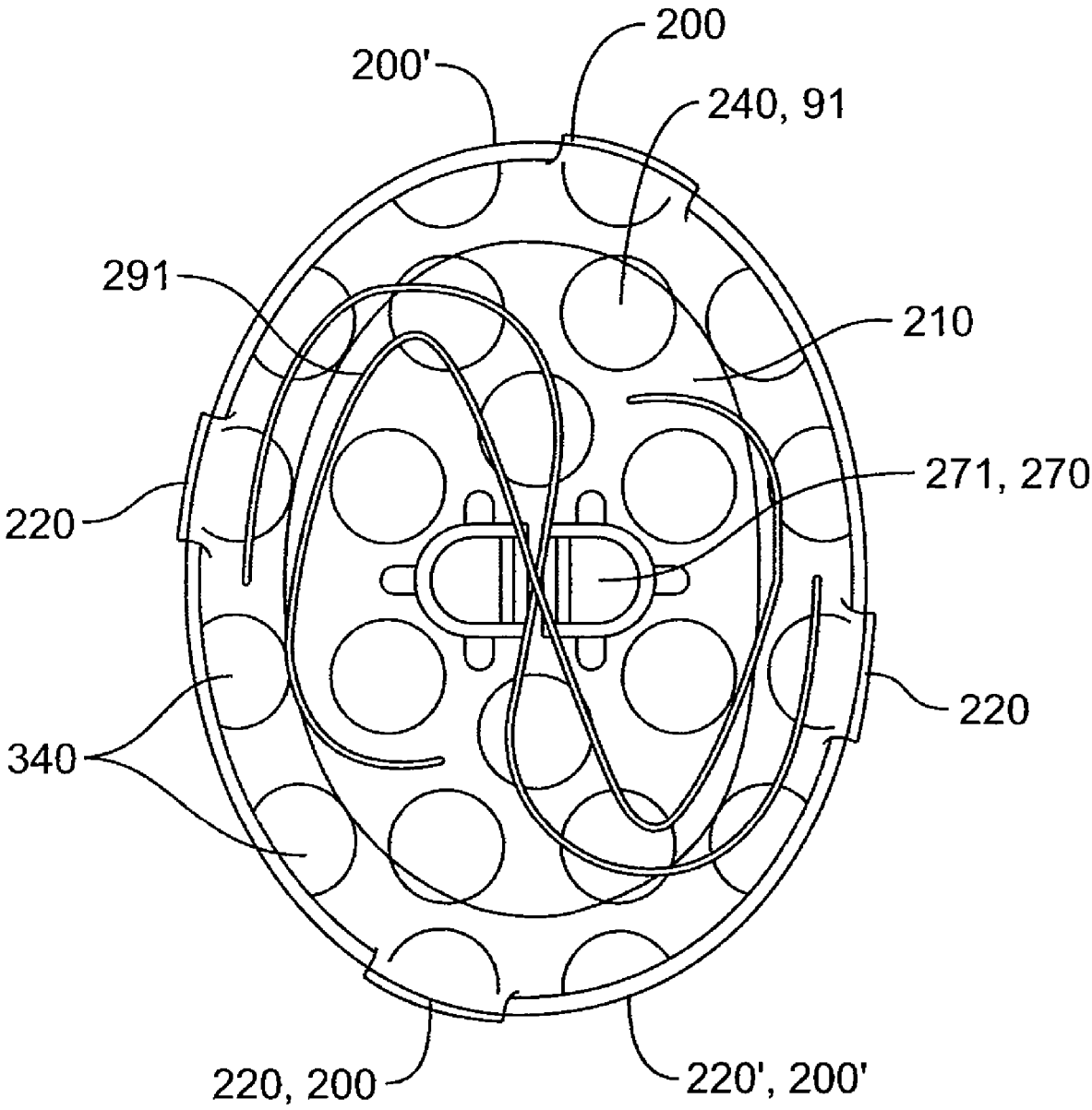
FIG. 12 is a top view of the embodiment of FIG. 11.

In the embodiment shown in FIG. 8, primary retaining elements 261 can comprise two flexible tabs 261*t* that define a clover leaf or dog bone shaped opening 280 having a central opening 281 for retaining feature 271 and openings 282 at the lobes of the clover leaf which can align with one or more aeration ports 91 of cap 90. In this respect, openings 282 serve as aeration openings 240. The fitting can also include one or more retaining openings 250 which mate with one or more secondary retaining features 272 so as to radially retain the fitting on the cap. In various embodiments, retaining features 272 can comprise pins, tabs and like elements.

The fitting is configured to be removed while the hearing aid or other hearing device 20 remains positioned in the ear canal. This can include, for example, when the hearing aid is positioned deep the in ear canal. Removal of the fitting can be achieved using selected levels of force that can be applied for example using a tool or by hand. Desirably, the fitting is configured to be removed with a sufficiently low force such the structure of the hearing aid and its position the ear canal are not appreciably disturbed (though some small movement of the hearing device can still occur).

A discussion will now be presented of various means and methods for removing the fitting. In various embodiments, the fitting can be removed by: i) a custom removal tool; ii) an off-the-self-tool such as a tweezers or forceps or like device; or iii) by hand (either that of the wearers or of another person). Typically, the fitting is configured to be pulled off by the use of a tensile force such as that from a tweezers, but it can also be configured to be twisted off, or to even be released under a compressive force, e.g., by pressing down on the top or sides of the fitting. The compressive force can be applied using a removal tool or other compressive force application means.

Figure 13:
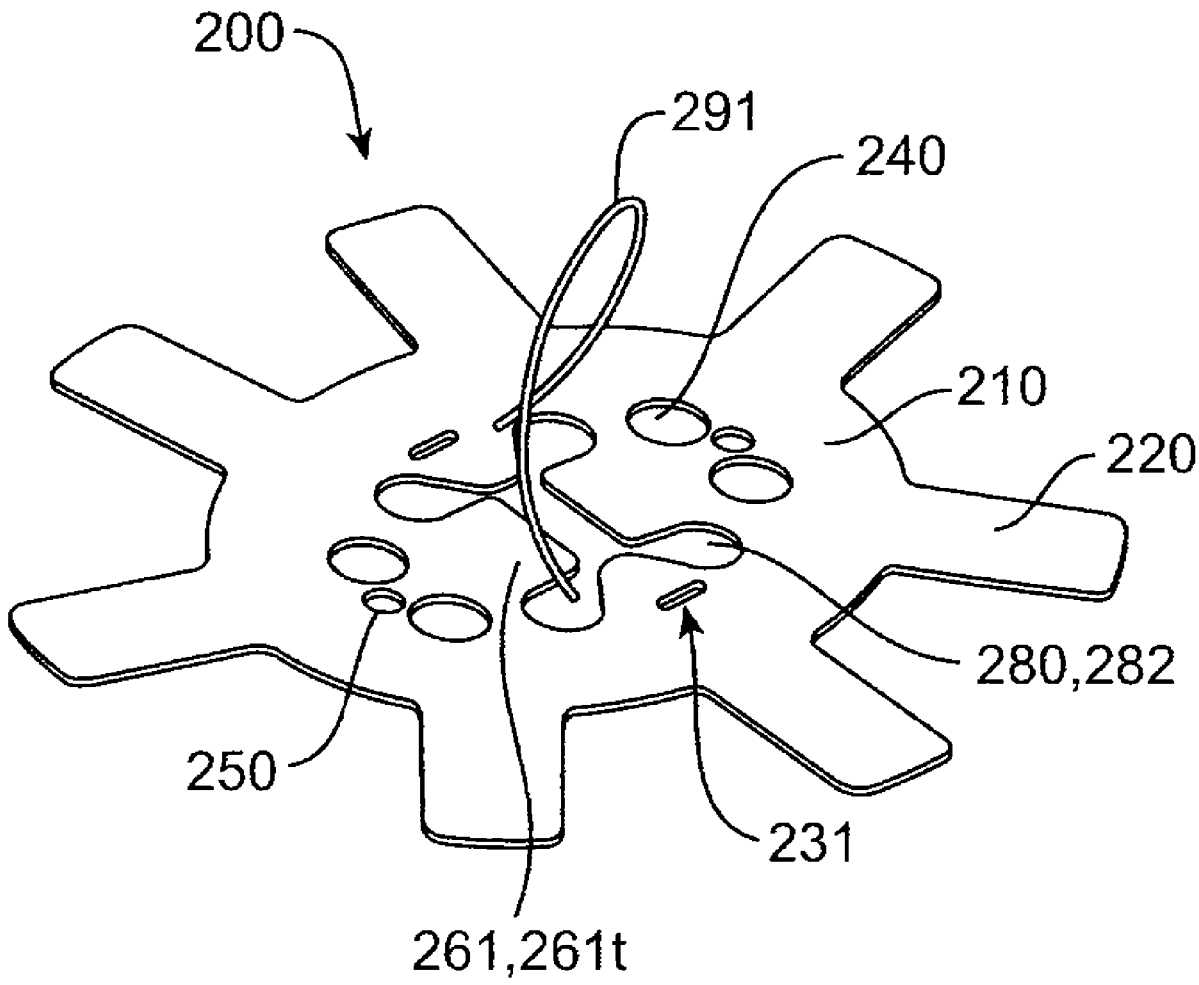
FIG. 13 is a perspective view of an embodiment of the fitting formed as a flat planer sheet.
Figure 14:
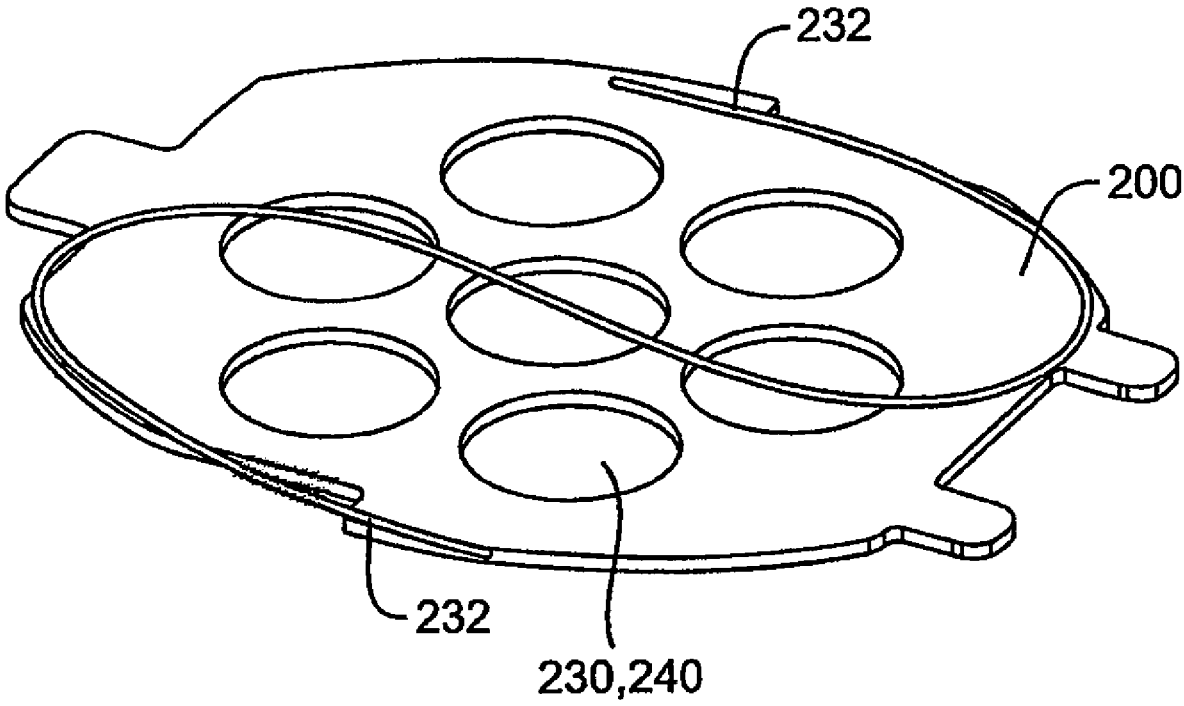
FIG. 14 is a top view of an embodiment of the fitting having an underlying slot for placement of the end of removal loop.
Figure 15A:
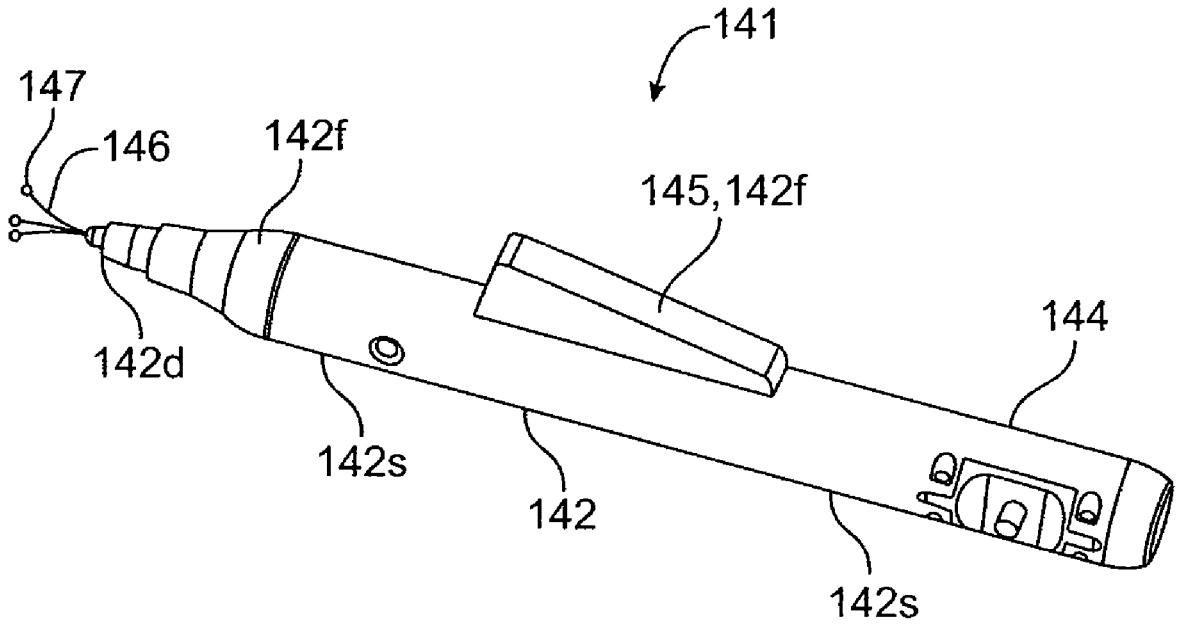
FIG. 15A is perspective view of an embodiment of a custom removal tool.
Figure 15B:
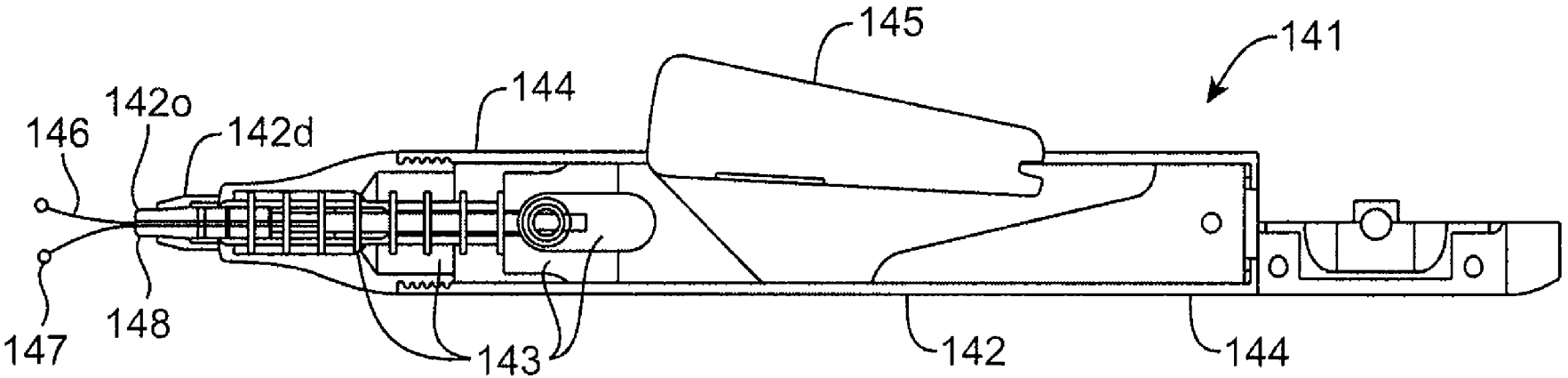
FIG. 15B is a side, partially transparent view of the embodiment of FIG. 15A showing the components of the mechanism.
Figure 15C:
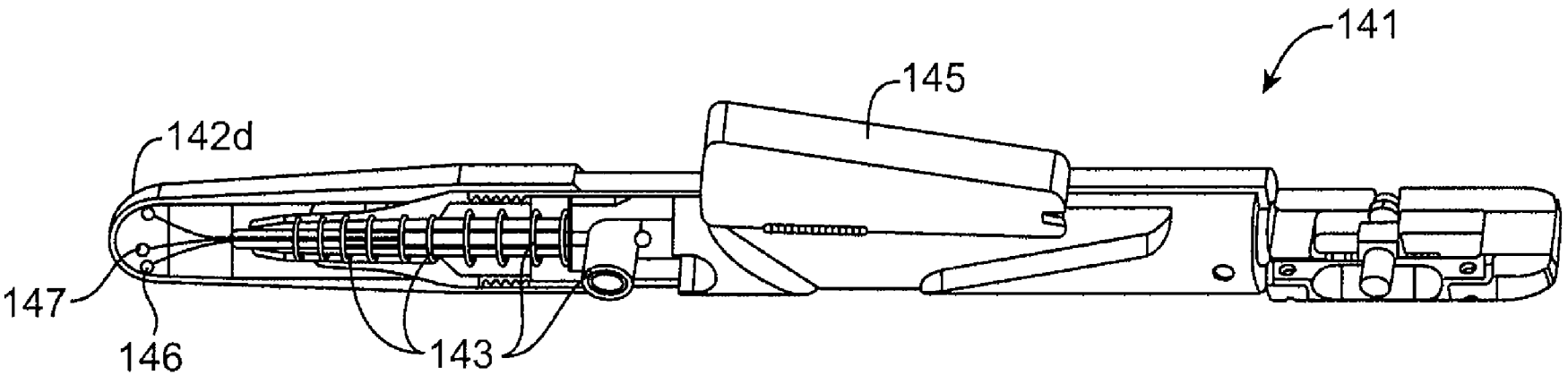
FIG. 15C is a perspective partially transparent view of the embodiment of FIG. 15A showing the flexible members withdrawn into the housing.
Figure 15D:
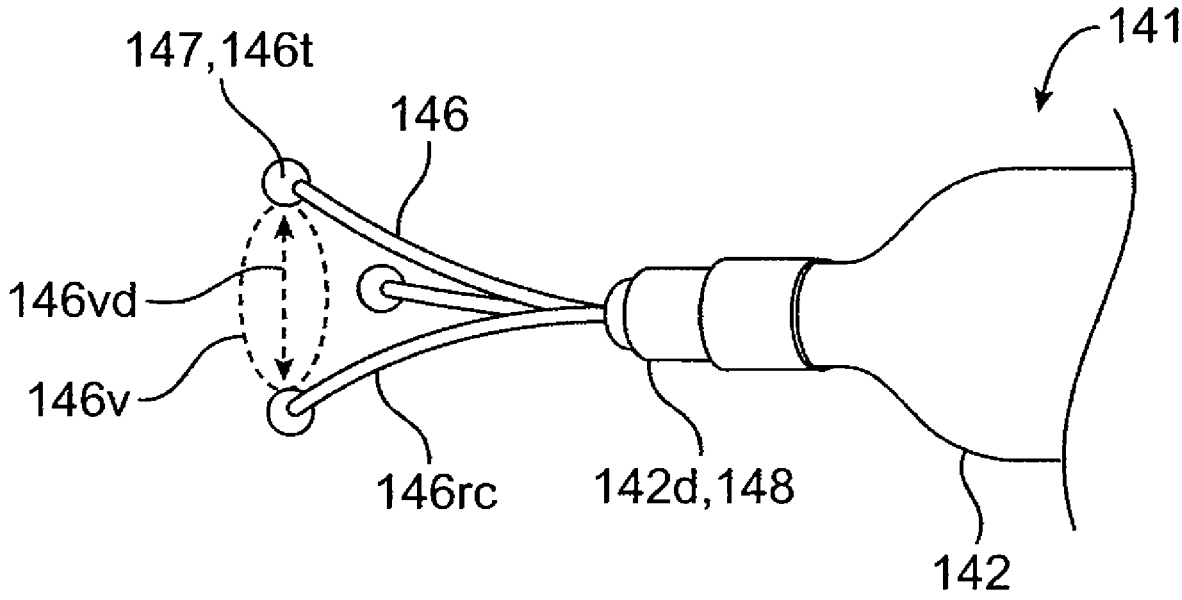
FIG. 15D is a perspective view of the distal end of the removal tool illustrating a conical volume defined by the flexible members.
Figure 15E:
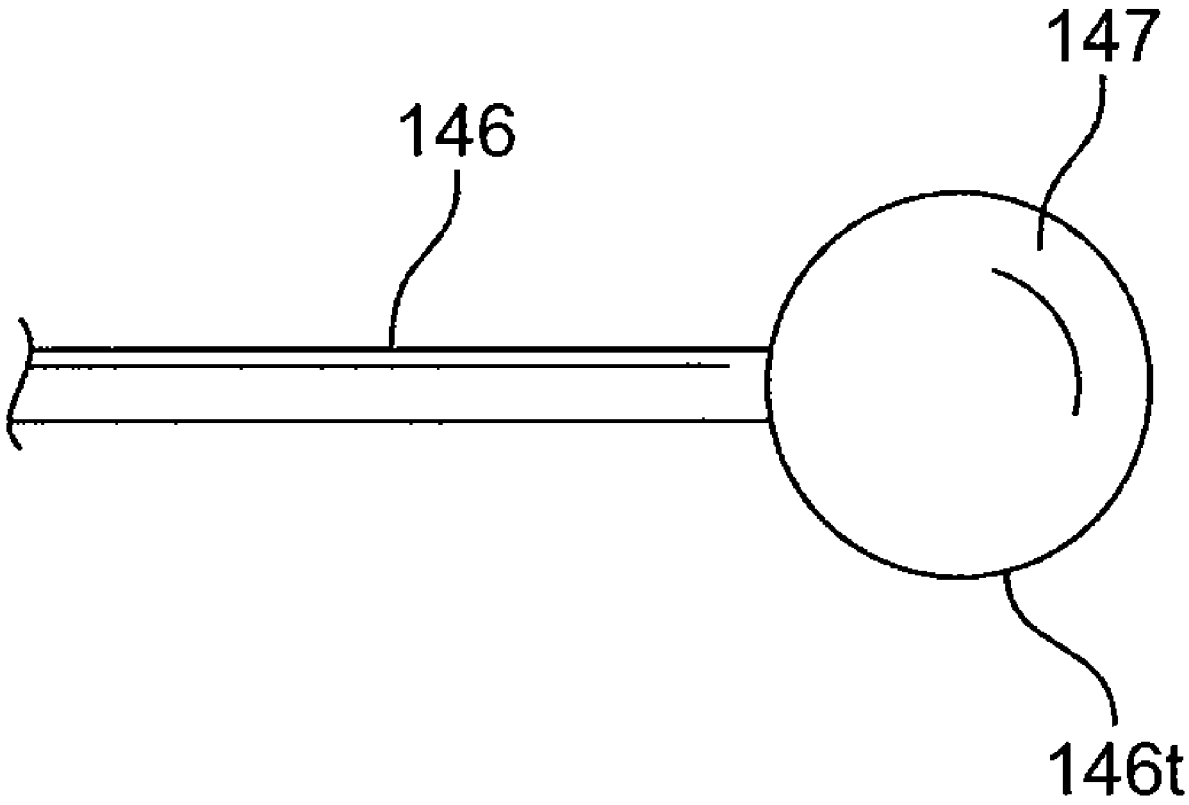
FIG. 15E is a perspective view illustrating an embodiment of a spherical shaped tip element.
Figure 15F:
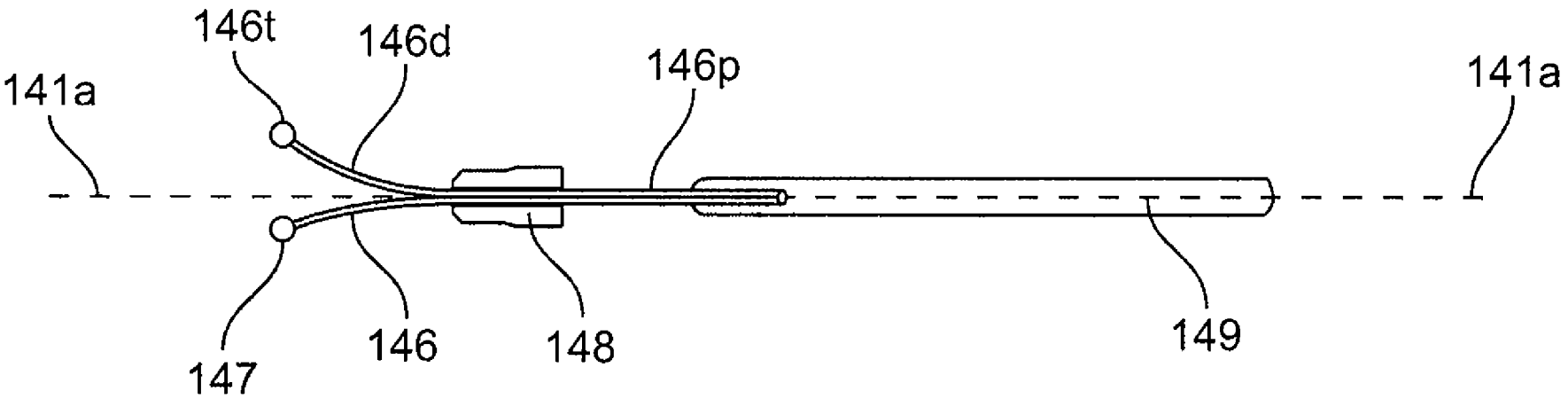
FIG. 15F is a perspective view illustrating positioning of the flexible members in advancement member and sleeve.
Figure 15G:
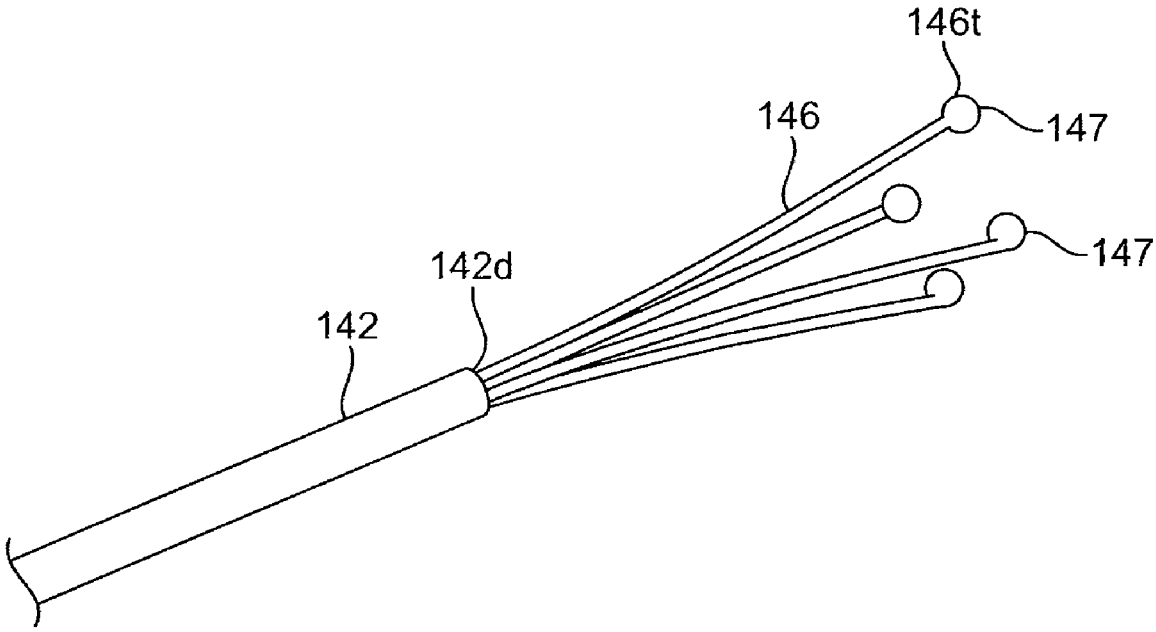
FIG. 15G is a perspective view of the distal portion of the tool illustrating the flexible members and tip elements in the flared state.
Figure 15H:
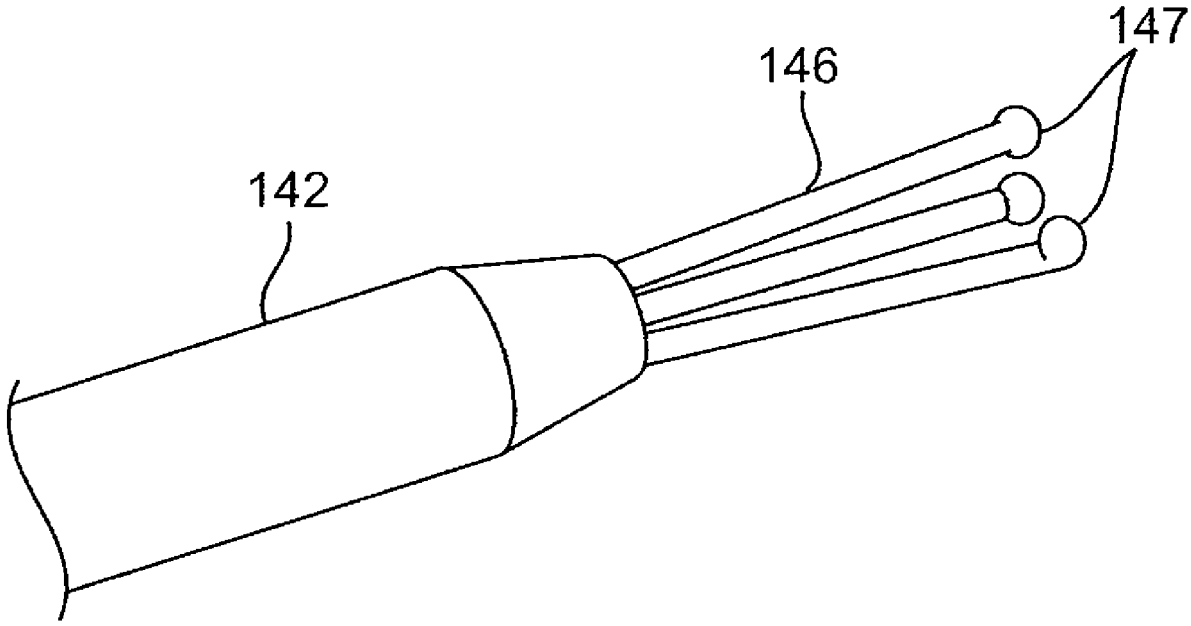
FIG. 15H is a perspective view of the distal portion of the tool illustrating the flexible members and tip elements in the contracted state.
Figure 15I:
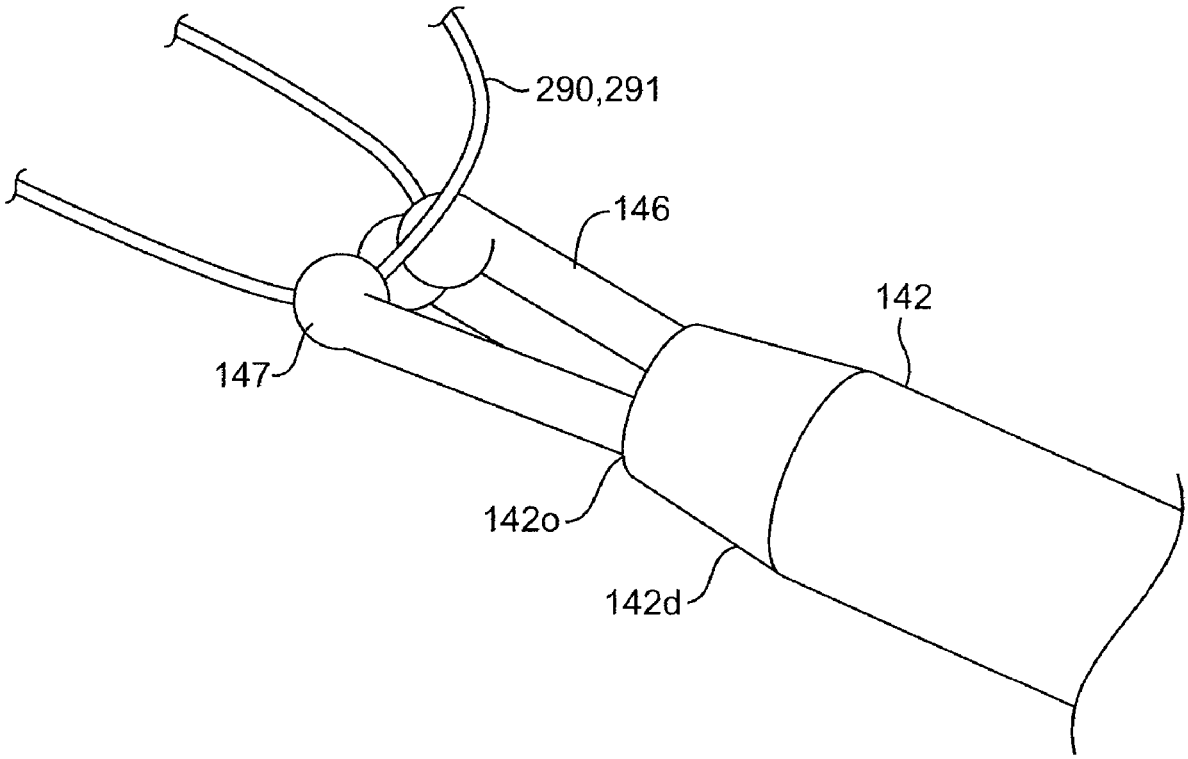
FIG. 15I is a perspective view of the distal portion of the tool illustrating engagement of the loop by the tip elements when in the contracted state.

In various embodiments, fitting 200 includes a removal element 290 configured to be engaged by a removal tool or even by hand so as to allow the fitting to be grasped and removed in situ in the ear canal. In preferred embodiments, the removal element comprises a loop 291. The loop can be engaged by one or embodiments of removal tool 140 and is attached to the fitting using an adhesive or other attachment means. The loop can be threaded through slot shaped 231 or other openings 230 in the fittings as is shown in FIG. 13. In one embodiment shown in FIG. 14, the ends of the loop can be threaded through an underlying sleeve or bore 232. Also, the loop can be integral and/or co-formed (e.g. co-molded) with the fitting. For example, the fitting and the loop can have an integral structure and be formed from the same material. In other embodiments, removal element 290 can comprise a hook member, an adhesive member, a VELCRO member, a magnetic member, a suction member and the like.

The loop can have a non-deployed state (e.g., when covered over by another fitting) and a deployed state (e.g., when the overlying fitting is removed) in which the loop can be engaged by the removal tool. Other embodiments of the removal element can also have deployed and non deployed states as well. In particular embodiments, the loop is configured to lie substantially flat against the surface of the top portion of the fitting when covered by an overlying fitting. The loop can have sufficient shape memory to spring to the deployed state when an overlying fitting is removed. The shape memory can also be such that the loop assumes a predictable shape when positioned in the non deployed state to facilitate stacking by overlying fittings. Also the loop can have a bending modulus configured to stand erect in the deployed state for ready engagement by the removal tool but without causing appreciable irritation to the ear canal. In use, this latter feature facilitates comfortable use of the fitting in the ear canal, particular with extended wear hearing devices.

The loop can be fabricated from a variety of materials including, without limitation, plastics, including suture-like material such as polypropylene; metals, such as spring steels or titanium alloys; or fibrous materials such as KEVLAR or SPECTRA. In the preferred embodiments, the loop is fabricated from a superlelastic shape memory material such as NITINOL. NITINOL is particularly useful for 'stacked' configurations of the fitting where the shape memory/super-elastic properties of the material allow an underlying loop to lie flat for long periods of time without appreciable creep and then readily 'pop-up' when the top is removed so as to easily snagged or otherwise engaged by a removal tool. Also the spring memory properties of NIITONOL causing it to pop up can actually facilitate removal of an overlying fitting. That is, once retaining elements 260 of an overlying fitting are released the loop serves to exert a force to help push up and release the overlying fitting. In this respect, the loop as a biasing spring.

In use, various embodiments of fitting 200 allow for the removal of cerumen and other contaminants that are adherent or otherwise attached to the cap or other hearing aid component while the hearing aid remains within the ear canal. This serves to clear clogged aeration openings on the hearing aid and thus improve one or more hearing aid parameters (e.g., gain) which can be adversely effected by blockage of the openings. It also serves to reduce the overall cerumen load on the cap which in turn improves the long term reliability of the cap and the hearing aid.

In many embodiments, the fitting is stacked on the cap or other hearing aid component so that multiple cerumen removals can be performed. With each removal, adherent cerumen is removed a fresh unobstructed fitting surface is unmasked along with openings on that surface (e.g., openings 230). A removal can be done at a set wear interval (e.g., two weeks or a month) or can be done whenever the user notices a degradation in performance of the hearing device (e.g., a decrease in volume). Removal can be performed after periods of substantially continuous wear or periods of non-continuous wear. Multiple cerumen removals provides for improved hearing aid performance and reliability over periods of extended wear of the hearing device without the need to remove the hearing device from the ear canal.

In specific embodiments, the fitting 200 is configured to remove cerumen adherent to various portions and!or features of cap 90 (and other portions of hearing aid 20), including cerumen obstructing one or more perforations 91 and/or underlying aeration openings 240. Selected portions of the fitting desirably have sufficient structural rigidity to remove a layer of cerumen infiltrating perforations 91. For example, portions of top portion 220 desirably have sufficient planar rigidity to pull out plugs of cerumen obstructing one or more perforations 91. The level of desired rigidity can be achieved by selection of the material for the fitting; fitting thickness or other dimension; and the placement and size of perforations 91.

A discussion will now be presented of embodiments of a custom removal tool for atraumatically removing a removable fitting or layer from a hearing device while the hearing device remains positioned in the ear canal. Referring now to FIGS. 15A-I, removal tool 140 can comprise a custom tool 141 having a user actuable mechanism 143 for engaging removal loops 131, 291 or other removal means 130. Tool 141 comprises a housing 142 that houses mechanisms 143. Typically the housing will include a gripable shaft portion 142*s* which functions as a handle 143. Though it should be appreciated that any portion of housing 142 can be configured as a handle 144 and the housing can include one or more features 142*f* for placement the users fingers/hand to facilitate manipulation of the tool by the user. Housing 142 also typically includes an actuator 145 for actuating the mechanism. Actuator 145 is operably coupled to mechanism 143 and can comprise a rocker, slide, lever, button and the like. Opposing buttons can be utilized to gain an increase in actuation range. The mechanism is operably coupled to a plurality of flexible members 146 which extend from an opening 142*o* at the distal end 142*d* of the housing. The tool will typically include between three to four flexible members, though other numbers are equally suitable. The members can comprise a metal wire material such as spring steel or a nickel titanium alloy (e.g., Nitinol) or other a resilient polymer. The diameter of the flexible members can be in the range from 0.006 to 0.025". The members will typically be pre-sprung or otherwise pre-shaped to flair outwards to define a cone or other conical like volume 146*v*, though other shapes can also be defined. The diameter 146*vd* of volume 146*v* is configured such that the flexible members fit into the ear canal when they are in their flared state. Typically, the diameter of the cone at the distal tips 146*t* of members 146 will be in the range of 3 to 8 mm. The diameter of the cone can be defined by configuring the flexible member to have a selected radius of curvature 146*rc*. As will be explained below, mechanism 142 can be engaged to deflect at least a portion of the flexible members from their flared state to a contracted state where the member tips snag or otherwise engage loops 131/291.

Each flexible members can include an engaging element 147 that is shaped to snare or otherwise engage loops 291 so as to exert a tensile force against the loop when the tool is removed from the ear canal. Typically, engaging element 147 is positioned at the tips 146*t* of member 146 and thus, for ease of discussion, will now be referred to as a tip elements 147. However, it should be appreciated that elements 147 can be positioned at varying locations along member 146 and each member can include multiple elements, for example, one at the tip 146*t* and others positioned more proximal. Typically, tool 141 will include three or four tip elements, one positioned on each flexible member. The flexible members and tip elements can be radially positioned around the longitudinal axis 141*a* of tool 141 such that tool can engage loops 291 and remove a fitting independent of the radial orientation of the tool with respect to hearing device 20 and/or the ear canal. In particular embodiments, this can be accomplished by equilaterally distributing the tip elements around the axis 141*a*. For example, in an embodiment having three tip elements, the elements could be offset 120° from each other.

Preferably, the tips elements are atruamatic such that their insertion into and contact with the ear canal does not readily injure or irritate the ear canal. In preferred embodiments, the tips elements are spherical-shaped but other shapes such as hooks, that create substantial shear relative to the snagged loops can also be used. These tips elements are sized such that a plurality of them can fit into the typical ear canal when the flexible members are in the flared state. Typically, the major diameter of the tip elements will be in the range from 0.015" to 0.090". The tip elements 147 can comprise biocompatible metal or plastic and can be attached to the flexible members using adhesive, or other joining methods known in the art. In one embodiment, the tip elements can comprise ball bearings that are brazed to stainless flexible members. The tip elements can also include a lubricous atraumatic coating such as silicone to reduce friction with the walls of the canal. The tip elements can also be magnetized to facilitate attachment to embodiments having loops 291/131 with a ferrous composition.

The tip elements 147 engage the removal loops by deflection of members 146 from their flared state to a contracted state in which they are less flared. Accordingly, mechanism 142 is configured to deflect the flexible tip members from their flared state to a contracted state such that tips come together. In one embodiment, this can be accomplished by configuring mechanism 143 to axially advance a sleeve or cone 148 over a portion of the flexible members. The sleeve can be directly or indirectly coupled to actuator 145 such that movement of the actuator advances and retracts the sleeve. In another embodiment, sleeve 148 can be fixed at the distal portion 142*d* of the housing and the mechanism can be configured to advances flexible members through the sleeve. This can be accomplished through the use of an advancement member 149 that is attached to the proximal portions of the flexible members 146 and operably coupled to actuator 145 such that movement of the actuator axial advances the advancement member within housing 142 to axial advance the flexible members through sleeve 148 and out of the housing. Advancement member 149 can comprise metal or plastic and can have a blind hole for insertion and attachment of flexible members 146. When completely advanced out of the sleeve, the flexible members are in their flared state. When a proximal portion 146*p* of the flexible members are withdrawn through the sleeve, the distal portions 146*d* of the members including the tip elements 147 are deflected to their contracted state. Mechanism 143 can be configured to have a direct or indirect link to advancement member 149 and/or sleeve 148 and can include one or more of springs, gears, and wires to convert movement of actuator 145 to the deflection and closure of tip elements 147. The mechanism can also be configured to provide force multiplication from movement from actuator 145 as well enable directional change of such movement.

In an exemplary embodiment of a method using tool 141, while holding the tool in their hand, the user (or another) advances the tip elements 147 into the ear canal and contacts the laterally facing surface of hearing device 20 that includes the removable fitting 200 or peelable layer 110. As the tool is actuated, the tip elements stay in a similar axial location, but through the movement of sleeve 148, the tip elements are radially brought together. As the elements come together, they contact, thereby 'trapping' the loop geometry. This capture of the loop by the tip elements allows the user to 'snag' the loop, thereby maintaining a robust connection. The tool can incorporate a latching feature, such that the tip elements stay fully together until the tool has been withdrawn and removal has been confirmed, without continuing depression of the actuator. As the tool is removed from the ear canal, the user can visually confirm the removal of the shedable fitting/layer by looking at the tip elements. By releasing the mechanism, the sleeve withdraws, the flexible members are resprung, and the tool is reset for further use. The tool can also be configured to produce an audible click when in the course of moving the actuator, when the flexible members are in their fully contracted state (e.g., when the tips members area in contact), when the tool is latched in, and when the flexible members are in their fully flared state.

OTHER EMBODIMENTS

Figure 16A:
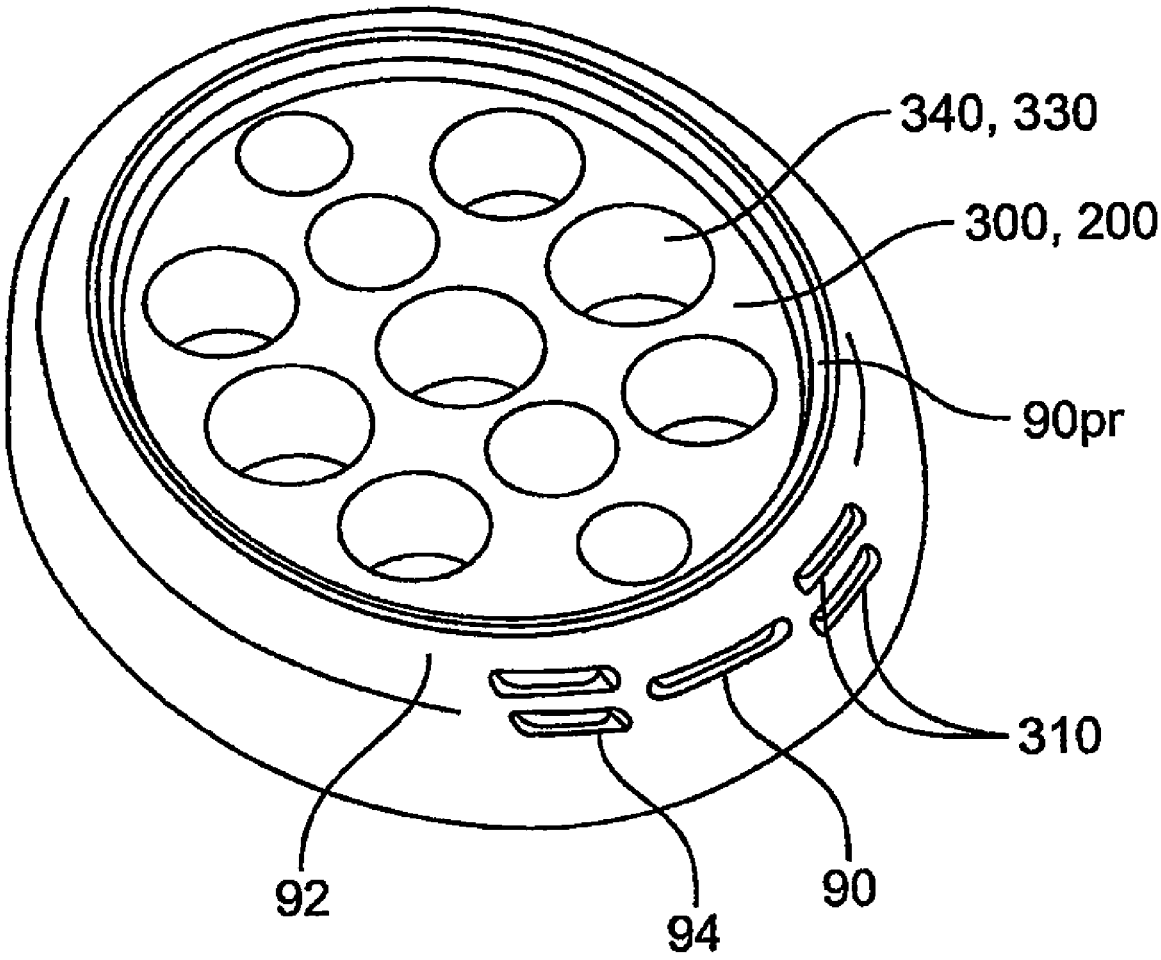
FIGS. 16A and 16B are perspective views of an embodiment of a removable fitting comprising sheddable sheets attached by stagger tabs.
Figure 16B:
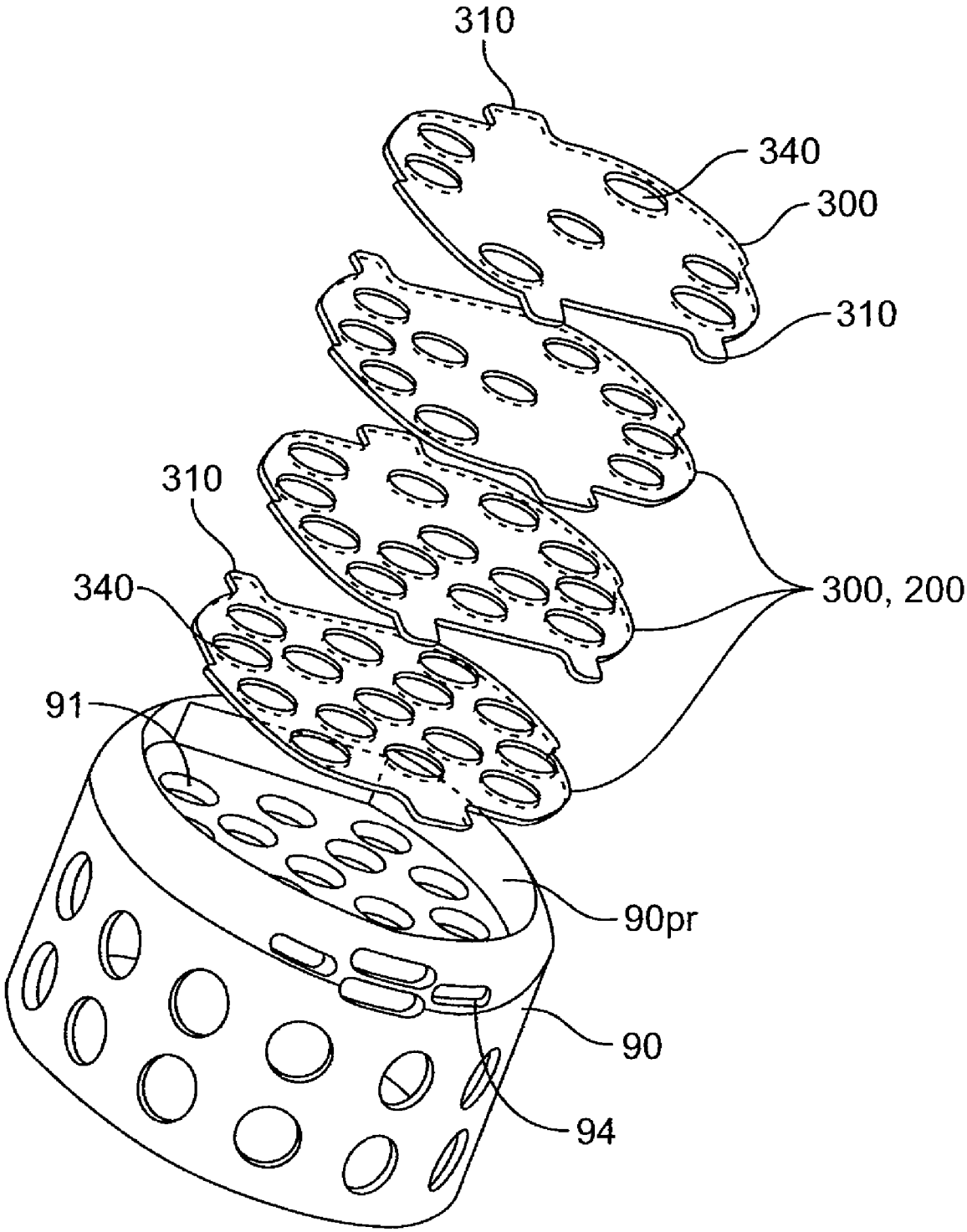
Figure 16C:
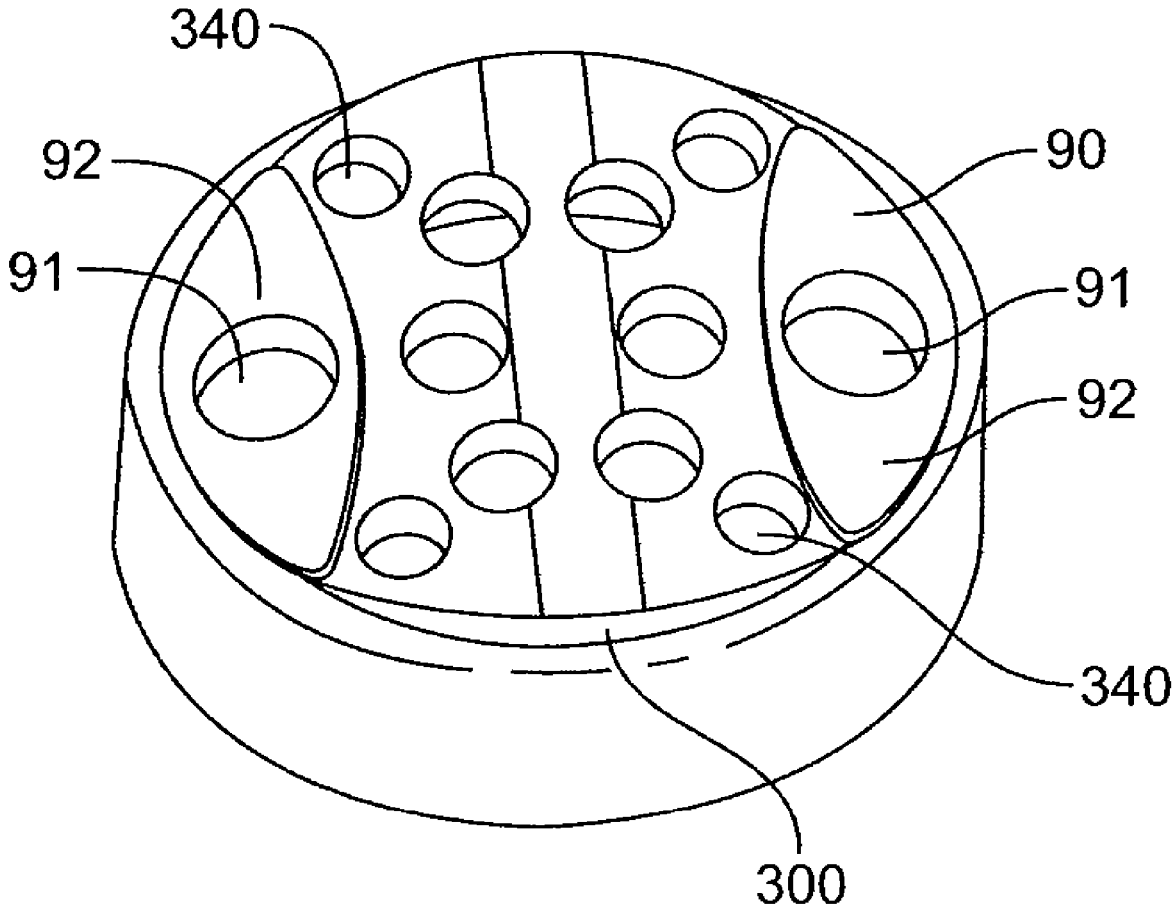
FIG. 16C is a perspective view of an embodiment of the sheddable sheets configured to be held in place by compressive forces from the cap.

Various other approaches and embodiments for a removable layer or fitting 200 are also contemplated within the scope of the invention. These embodiments are equally suitable for removing cerumen to other embodiments described above. In various embodiments fitting 200 can be retained on cap 90 using other means besides retaining features and leg members. Referring now to FIGS. 16A and 16B, in some embodiment fittings 200 can comprise sheddable sheets 300 held in place by two or more stagger tabs 310 that insert into retention holes 94 in cap 90. The sheets can sunken into a perimeter rim 90*pr* of cap 90 to maintain their stability on the cap. They are removed by being grabbed in the center and pulled up, thereby releasing the stagger tabs at either end of the sheet 300. The removal of each sheet 300 exposes fresh device faces and openings 330 including aeration openings 340. In an embodiment shown in FIG. 16C, sheets 300 can be held in place by a cap 90 configured to exert compressive forces on the sheets.

Figure 17A:
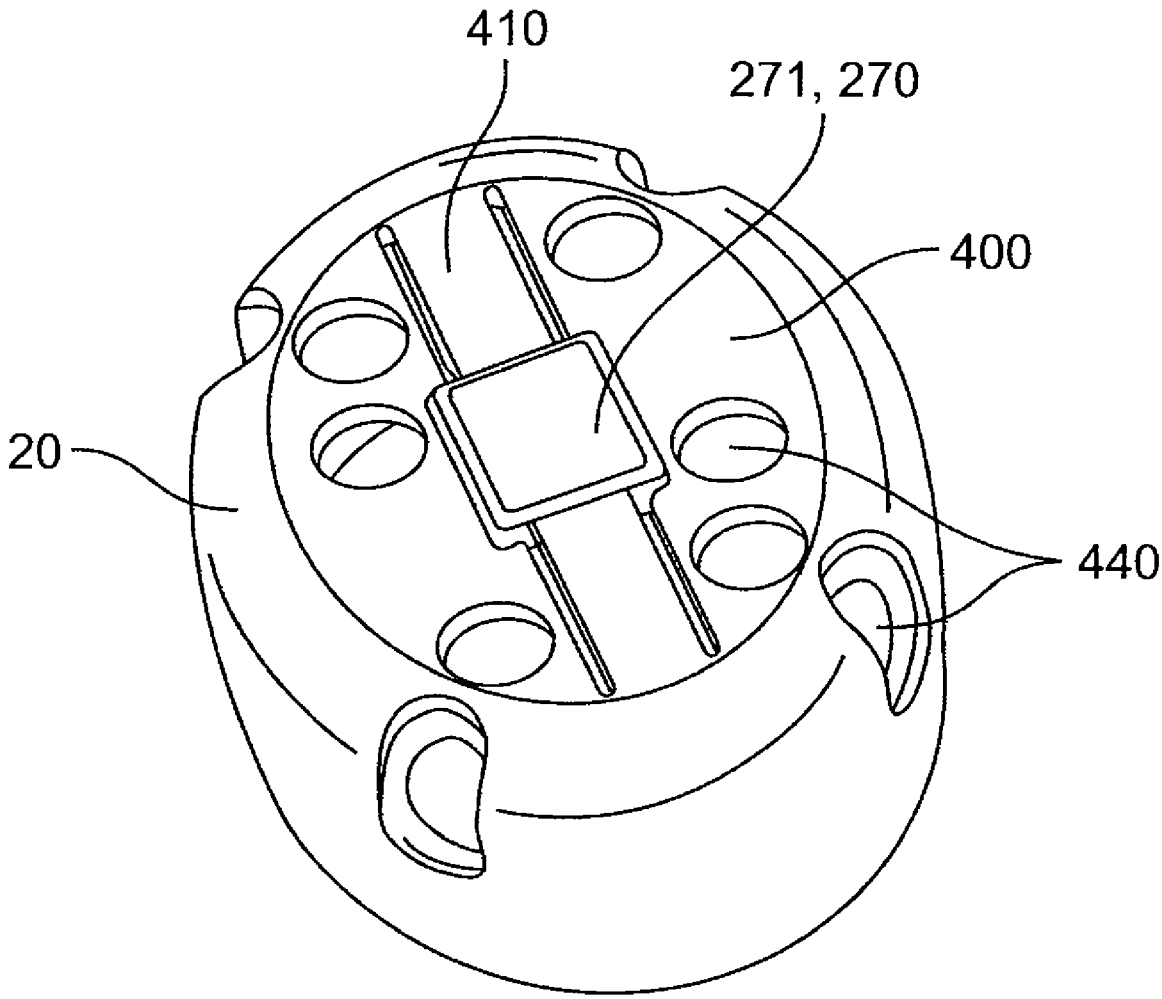
FIGS. 17A and 17B are perspective views of an embodiment of the removable fitting comprising concentrically stacked caps.
Figure 17B:
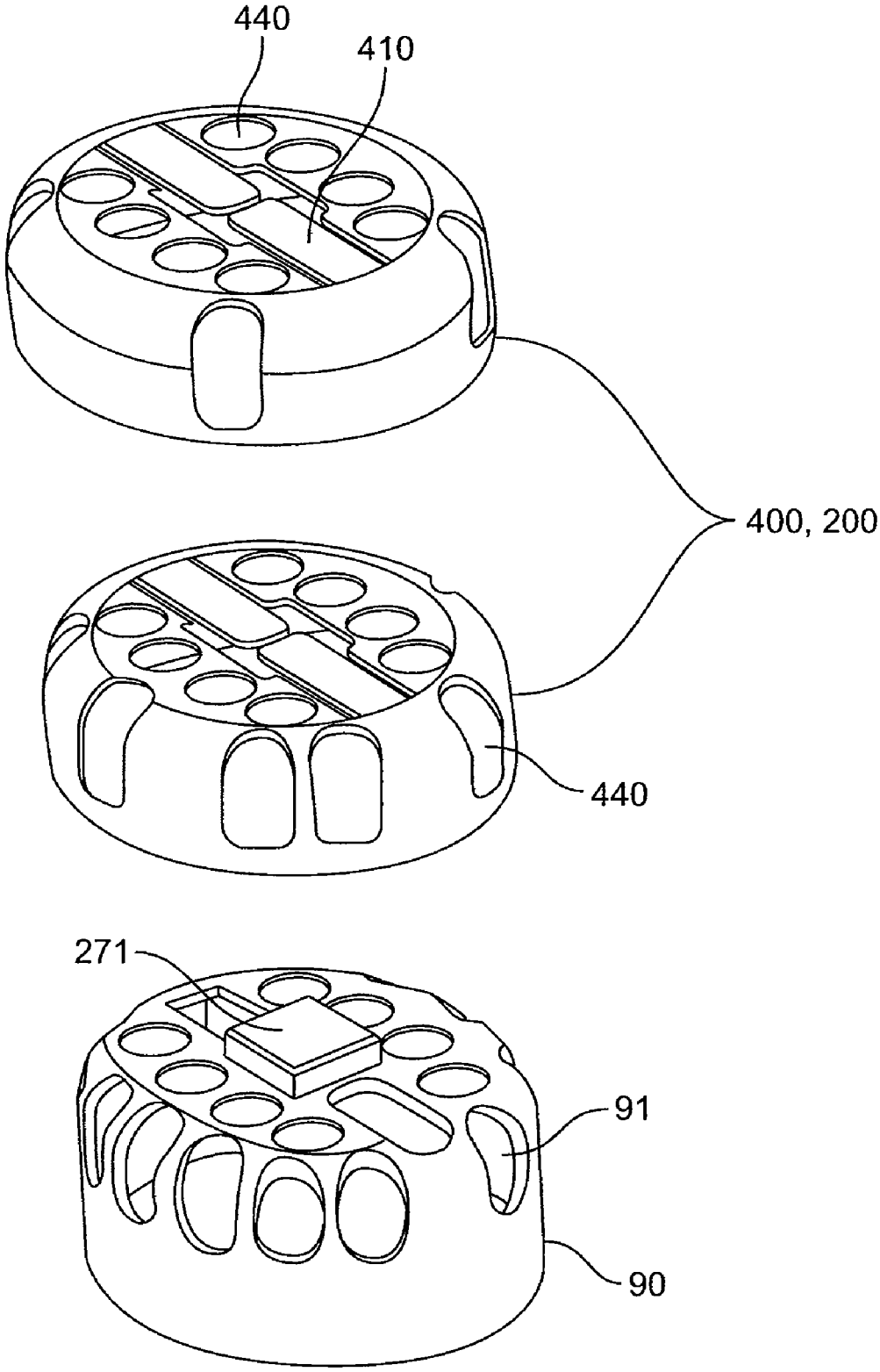

Referring now to FIGS. 17A and 17B, in other embodiments, fittings 200 can comprise concentric caps 400 which are configured to be concentrically stacked on cap 90. Each cap 400 features a centrally-directed cantilevered beam 410 that is deflected for cap removal (e.g. using a removal tool). Each successive cap removal clears the hearing device face, radii, sides, and also unmasks new aeration holes 440.

In various other embodiments, the fitting can be coupled to the cap using a peelable adhesive which can applied as a laminate to all or portions of the fitting. In still other embodiments, all or a portion of the fitting can be fabricated from an elastomeric polymer or other complaint material so as to stretch over portions of the cap 90 and/or hearing aid 20. The fitting is then removed using one or more removal loops or other removal element described herein

CONCLUSION

The foregoing description of various embodiments of the invention has been presented for purposes of illustration and description. It is not intended to limit the invention to the precise forms disclosed. Many modifications, variations and refinements will be apparent to practitioners skilled in the art. Further, the teachings of the invention have broad application in the hearing device fields as well as other fields which will be recognized by practitioners skilled in the art.

Elements, characteristics, or acts from one embodiment can be readily recombined or substituted with one or more elements, characteristics or acts from other embodiments to form numerous additional embodiments within the scope of the invention. Moreover, elements that are shown or described as being combined with other elements, can in various embodiments, exist as stand alone elements. Hence, the scope of the present invention is not limited to the specifics of the exemplary embodiment, but is instead limited solely by the appended claims.

What is claimed is:

1. A removal tool for atraumatically removing a removable fitting from a hearing device inserted deeply in the ear canal of a user, the removal tool comprising:

a housing adapted to be grasped in the hand;

a plurality of flexible members partially positioned in the housing and extending from the housing, at least a portion of the flexible members having an outwardly flared distal portion, at least one flexible member including an engagement element positioned at the flared distal portion of the member for engaging a removal element on the fitting; and a mechanism for engaging the engagement element with the removal element for removal of the fitting independent of a radial orientation of the housing with respect to the hearing device.

2. The removal tool of claim 1, wherein the hearing device is a CIC hearing aid.

3. The removal tool of claim 1, wherein the mechanism inwardly deflects the engagement element to bring it into contact with the removal element.

4. The removal tool of claim 3 wherein the mechanism locks the engagement element in contact with the removal element.

5. The removal tool of claim 1, wherein the mechanism includes an actuator positioned on the housing.

6. The removal tool of claim 1, wherein the plurality of flexible members includes at least three flexible members.

7. The removal tool of claim 1, wherein a flexible member comprises at least one of steel, spring steel, super elastic material or shape memory material.

8. The removal tool of claim 1, wherein the flared distal portions are pre-sprung.

9. The removal tool of claim 1, wherein the flared distal portions are radially distributed around a longitudinal axis of the tool.

10. The removal tool of claim 1, wherein the removal element is a loop structure.

11. The removal tool of claim 1, wherein the fitting is a planar sheet, a cap or a crown shaped structure.

12. The removal tool of claim 1, further comprising a sleeve coaxially positioned over the flexible members, the sleeve configured to inwardly deflect the flared distal portions of the members.

13. The removal tool of claim 12, wherein the sleeve is slidable over the flexible members.

14. The removal tool of claim 1, further comprising an advancement member coupled to a proximal portion of the flexible members, the advancement member configured to advance the members in and out of the housing.

15. The removal tool of claim 1, wherein the flared distal portions of the flexible members define a conical volume having a major diameter allowing insertion of the flared distal portions into the ear canal.

16. The removal tool of claim 1, wherein an engagement element is substantially spherically shaped.

17. The removal tool of claim 1, wherein an engagement element is magnetized.

18. The removal tool of claim 1, wherein each flexible member includes an engagement element so that the tool includes a plurality of engagement elements.

19. The removal tool of claim 18, wherein the engagement elements are configured to engage the removal element without precise positioning of the engagement elements with respect to the hearing device or the ear canal.

20. The removal tool of claim 18, wherein the engagement elements are configured to center the removal tool in the ear canal during insertion.

21. The removal tool of claim 18, wherein the engagement elements are configured to allow the user to engage the removal element without direct visual observation of the removal tool.

* * * * *